US006254523B1

(12) United States Patent
Yamamoto et al.

(10) Patent No.: US 6,254,523 B1
(45) Date of Patent: Jul. 3, 2001

(54) METHOD OF IMPARTING DIRECTIONAL PERMANENCY OF FOLDING TO SHEET, AND APPARATUS THEREFOR

(75) Inventors: Masahiro Yamamoto, Osaka; Yoshimasa Yokoyama, Kohbe, both of (JP)

(73) Assignees: Hitachi Zosen Corporation; Yokoyama Sankoh Co., Ltd., both of (JP)

( * ) Notice: Subject to any disclaimer, the term of this patent is extended or adjusted under 35 U.S.C. 154(b) by 0 days.

(21) Appl. No.: 09/171,495

(22) PCT Filed: Apr. 22, 1997

(86) PCT No.: PCT/JP97/01389

§ 371 Date: Mar. 10, 1999

§ 102(e) Date: Mar. 10, 1999

(87) PCT Pub. No.: WO97/39884

PCT Pub. Date: Oct. 30, 1997

(30) Foreign Application Priority Data

Apr. 23, 1996 (JP) ..... 8-101688

(51) Int. Cl.[7] ..... B31F 7/00

(52) U.S. Cl. ..... 493/451; 493/463; 493/458; 493/447; 493/966; 493/474

(58) Field of Search ..... 493/451, 463, 493/458, 448, 447, 966, 417, 474, 476, 479, 941

(56) References Cited

U.S. PATENT DOCUMENTS

| | | | | |
|---|---|---|---|---|
| 2,538,671 | * | 1/1951 | Crowe | 493/463 |
| 4,200,032 | * | 4/1980 | Roda | 493/463 |
| 4,578,052 | * | 3/1986 | Engel et al. | 493/417 |
| 5,200,013 | * | 4/1993 | Traber | 493/463 |
| 5,669,204 | * | 9/1997 | Blaisdell | 493/451 |
| 5,755,078 | * | 5/1998 | Hurtig, Jr. et al. | 493/451 |

* cited by examiner

*Primary Examiner*—Stephen F. Gerrity
*Assistant Examiner*—Sam Tawfik
(74) *Attorney, Agent, or Firm*—Lorusso & Loud

(57) ABSTRACT

A method of imparting directional permanency of folding to a sheet, and an apparatus therefor, which is suitable for manufacturing frame bodies, cushioning members and other block products for packaging, from a sheet of paper and other recyclable materials. The method includes a step of moving respective folding working tools, disposed on one or both surfaces of a sheet, required amounts so as to fold the sheet along respective folding ruled lines, and a step of shortening spacings between the respective folding working tools in a uniform ratio in accordance with an apparent amount of shortening in a longitudinal dimension caused by the shifting, while synchronizing with the moving step. Directional permanency of folding can be accurately imparted to the sheet along the folding ruled lines.

13 Claims, 20 Drawing Sheets

METHOD OF IMPARTING DIRECTIONAL PERMANENCY OF FOLDING TO SHEET, AND APPARATUS THEREFOR

FIELD OF THE INVENTION

This invention relates to a method of imparting directional permanency of folding to a sheet efficiently, when one or a plurality of ridge-like (outward) folds and one or a plurality of valley-like (inward) folds are formed alternately in a sheet such as a pasteboard, a corrugated cardboard or other sheets having some degree of hardness, along folding ruled lines formed in parallel and orthogonal to the longitudinal dimension of the sheet, so that the sheet is folded accurately in accordance with the design in the following processing. This invention also relates to an apparatus for the method.

BACKGROUND OF THE INVENTION

Recently, it has been proposed to use, as frame bodies for protecting and packaging an electric or electronic equipment product effectively when the articles are packed in a case or cushioning members for packaging, a recyclable sheet such as a pasteboard or a corrugated cardboard instead of a plastic foam body such as styrene foam.

One frame body or cushioning member is a corrugated cardboard block formed by zigzag folding of the sheet.

Another frame body or cushioning member using corrugated cardboard or the pasteboard is, for example, as disclosed in Japanese Utility Model Application laid-open No.60-32274, a hollow block with a pseudo-honeycomb section formed by repeatedly folding a sheet at a predetermined interval and bonding or connecting necessary folds (folded parts) to each other.

In manufacturing the above-mentioned frame bodies or cushioning members, at first, the sheet member such as the pasteboard or the corrugated cardboard is cut according to the design and folding ruled lines are formed orthogonal to the longitudinal dimension of the sheet with press lines by a press, perforated lines, intermittent cutting lines or the like according to the design.

Next, the sheet is folded along the above-mentioned ruled lines so that the ridge-like folds and the valley-like folds are formed alternately and then necessary portions are pasted to each other to make a block of a desired shape.

The frame bodies or cushioning members should be manufactured to have an accurate shape and size, since, as previously mentioned, they are used for supporting articles properly and protecting the articles from impact in circulation and for packaging the articles easily and efficiently.

It is difficult to manufacture the product of an accurate shape and size because the folded part tends to shift easily when the sheet, formed as above-mentioned, is folded by industrial means along the folding ruled lines. In order to fold the sheet along the folding ruled lines accurately and industrially, it is preferable to give directional permanency of folding (folding habit) to the folding ruled lines of the sheet.

However, no industrial means for imparting accurate directional permanency of folding to the sheet along many folding ruled lines formed in the sheet has been developed (it has been conducted by handwork). Therefore, the frame bodies or cushioning members of plastic foam have not been yet replaced by those using the sheet of a pasteboard, a corrugated cardboard or other recyclable materials.

DISCLOSURE OF THE INVENTION

An object of the present invention is to provide a method of imparting directional permanency of folding to a sheet accurately and quickly along many folding ruled lines formed in the sheet beforehand, in the manufacturing process of the frame bodies, cushioning members or other block products made of paper or other easily recyclable materials.

Another object of the present invention is to provide an apparatus for suitably performing the method of imparting directional permanency of folding to a sheet to achieve the abovementioned object.

Another object of the present invention is to provide an apparatus for imparting directional permanency of folding to a sheet, which is capable of forming two different kinds of ridge-like folds (a reverse V-shaped fold and a reverse U-shaped fold) and two different kinds of valley-like folds (a V-shaped fold and a U-shaped fold) in the same apparatus.

Another object of the present invention is to provide an apparatus for imparting directional permanency of folding to a sheet, which is capable of imparting directional permanency of folding, to various kinds of sheet in the same apparatus, even though the distances between folding ruled lines formed in a large number in the sheet vary depending on the kind of sheet to be processed.

In order to achieve the above-mentioned objects, the method of imparting directional permanency of folding to a sheet according to the present invention is as follows.

A method of imparting directional permanency of folding to a sheet according to the first embodiment of the method of the present invention comprises, in a process for forming ridge-like folds a6 and valley-like folds a7 alternately in a sheet a, a first step of supplying the sheet a formed with many folding ruled lines a2 in parallel and orthogonal to the longitudinal dimension of the sheet, to a predetermined working position lb, a second step of disposing respective folding working tools 21–26 along the respective folding ruled lines a2 on the surface of the sheet which becomes an inner surface when the sheet a is folded along the respective folding ruled lines a2, a third step of shifting respective folding working tools 21–26, 31–36, disposed on one or both surfaces of the sheet a, in required amounts in the folding direction along respective folding ruled lines 2*a* and a fourth step of shortening distances between the respective folding working tools 21–26, 31–36 at a uniform ratio in accordance with an apparent amount of shortening of the longitudinal dimension caused by the shifting, while synchronizing with the third step.

According to the method of imparting folding directional permanency to a sheet of the first embodiment, since the method comprises the third step of shifting respective folding working tools 21–26, 31–36, disposed on one or both surfaces of the sheet a, in required amounts so that the sheet a is bent along the respective folding ruled lines a2 and the fourth step of shortening distances between the respective folding working tools 21–26, 31–36 at a uniform ratio in accordance with an apparent amount of shortening of the longitudinal dimension caused by the shifting while synchronizing with the third step, the folding directional permanency can be imparted to the sheet a along the folding ruled lines a2 accurately and industrially.

Therefore, it enables the product to be manufactured in an accurate solid shape from the sheet a industrially.

A method of imparting directional permanency of folding to a sheet according to a second embodiment of the present invention comprises, in addition to the steps of imparting directional permanency of folding to a sheet according to the first embodiment, a fifth step of moving the respective folding working tools 21–26, 31–36 away from the sheet a after the fourth step and a sixth step of returning the respective folding working tools 21–26, 31–36 to the initial position, and the first step to the sixth step are repeated.

According to the method of imparting folding directional permanency to a sheet in the second embodiment, since the method comprises the fifth step of moving the respective folding working tools 21–26, 31–36 away from the sheet a and the sixth step of returning the respective folding working tools 21–26, 31–36 to the original position and a cycle from the first step to the sixth step is repeated, directional permanency of folding can be imparted to a long sheet continuously and accurately.

A method of imparting directional permanency of folding to a sheet according to a third embodiment of the present invention is a modification of the process of imparting directional permanency of folding to a sheet according to the first embodiment, wherein the sheet a is supplied to a predetermined working position lb in the second step by conveying it from one side to the other side along its longitudinal direction, the folding working tool located at the beginning or the end of the working position, in the conveyance direction of the sheet a in the second step, is defined as a reference, and the other working tools are moved toward the reference working tool in the fourth step.

According to the method of imparting directional permanency of folding to a sheet of the third embodiment, since the sheet a is supplied to the working position lb by conveying it from one side to the other side in a path extending along its longitudinal dimension in the second step, the directional permanency of folding can be applied to a long sheet more smoothly.

A method of imparting directional permanency of folding to a sheet according to a fourth embodiment of the present invention involves a modification of the fourth step of the third embodiment, wherein the reference working tool is moved in the same or opposite direction of movement of the sheet a in the second step.

According to the method of imparting directional permanency of folding to a sheet of the fourth embodiment, since the folding working tool located at the beginning of the working position, in the moving direction of the sheet a by the conveying means, is defined as a reference and the reference working tool is moved along the moving direction of the sheet a in the second step, together with the other working tools, in the fourth step, directional permanency of folding can be applied more smoothly to the long sheet continuously.

A method of imparting directional permanency of folding to a sheet according to a fifth embodiment of the present invention comprises, in a process for forming ridge-like folds a6 and valley-like folds a7 alternately in a sheet, a first step of supplying the sheet a formed with many pairs of parallel folding ruled lines a2 in parallel and orthogonal to the longitudinal dimension of the sheet, to a predetermined working position lb, a second step of disposing pairs of the folding working tools 21•31–26•36 along the pairs of the respective folding ruled lines a2 on the surface of the sheet which becomes an inner surface when the sheet a is folded along the respective folding ruled lines a2, a third step of shifting respective pairs of the folding working tools 21•31–26•36, disposed on one or both surfaces of the sheet a, in required amounts in the folding direction along the respective pairs of the folding ruled lines a2 and a fourth step of shortening distances between the respective pairs of the folding working tools 21•31–26•36 at a uniform ratio in accordance with an apparent amount of shortening of the longitudinal dimension caused by the shifting while synchronizing with the third step.

According to the method of imparting folding directional permanency of folding to a sheet of the 5th embodiment, since the method comprises the third step of shifting respective pairs of the folding working tools 21•31–26•36, disposed on one or both surfaces of the sheet a, in required amounts so that the sheet a is bent along the respective pairs of the folding ruled lines a2 and the fourth step of shortening distances between the respective folding working tools 21•31–26•36 at a uniform ratio in accordance with an apparent amount of shortening of the longitudinal dimension caused by the shifting while synchronizing with the third step, the directional permanency of folding can be imparted to the sheet a along the pairs of the folding ruled lines a2 accurately and industrially to produce a hollow block from the sheet.

A method of imparting directional permanency of folding to a sheet according to a sixth embodiment of the present invention comprises, in addition to the steps of the method of the fifth embodiment, a fifth step of moving the respective pairs of the folding working tools 21•31–26•36 away from the sheet a after the fourth step and a sixth step of returning the respective pairs of the folding working tools 21•31–26•36 to the initial position, and the first to the sixth steps are repeated.

According to the method of imparting directional permanency of folding to a sheet in the sixth embodiment, since the method comprises the fifth step of moving the respective pairs of the folding working tools 21•31–26•36 away from the sheet a and the sixth step of returning the respective pairs of the folding working tools 21•31–26•36 to the original position and a cycle from the first step to the sixth step is repeated, directional permanency of folding can be imparted to a long sheet along the pairs of the ruled lines a2 continuously and accurately.

A method of imparting directional permanency of folding to a sheet according to the seventh embodiment of the present invention is a modification of the fifth embodiment wherein the sheet a is supplied to the predetermined working position lb in the second step by transporting it from one side to the other side in a path extending along its longitudinal dimension.

According to the method of imparting directional permanency of folding to a sheet of the seventh embodiment, since the sheet a is supplied by transporting it from one side to the other side in a path extending along its longitudinal dimension, the directional permanency of folding can be applied to the sheet along the pairs of the folding ruled lines a2 more smoothly.

A method of imparting directional permanency of folding to a sheet according to an eighth embodiment of the present invention involves a modification of the fourth step of the method according to the seventh embodiment, wherein the distances between the respective pairs of the working tools are shortened while they are moved along the conveyance direction of the sheet in the second step.

According to the eighth embodiment, since the respective pairs of the working tools 21•31–26•36 are moved along the conveyance path of the sheet a, the directional permanency of folding can be more smoothly applied to a long sheet continuously.

A method of imparting directional permanency of folding to a sheet of a 9th embodiment of the present invention is a modification of the fifth embodiment wherein the folding working tools of the pair are constituted separately, and are moved synchronously by respective driving means in the fourth step.

In the method of the 9th embodiment, since the folding working tools of the pair are constituted separately, and are moved synchronously by respective driving means in the fourth step, the distances between the folding working tools of the pair can be adjusted.

The method of the 10th embodiment of the present invention is also a modification of the fifth embodiment, wherein the folding working tools of the pair are constituted unitarily and are moved by a single driving means in the fourth step.

In the method of the 10th embodiment, since the folding working tools of the pair are constituted unitarily and are moved by the same driving means in the fourth step, control becomes unnecessary to keep the distance between the folding working tools of the pair constant or the amount of the control becomes small.

A method of imparting directional permanency of folding to a sheet according to 11th embodiment of the present invention is a modification of the first or the fifth embodiment wherein the sheet a is a corrugated cardboard, at least some of the ruled lines a2 are intermittent cutting lines formed by cutting the sheet a intermittently across the corrugations al of the corrugated cardboard or are each composed of a cut portion a3 of a predetermined length formed on the sheet a by cutting, a non-cut portion a4 of a shorter length than the cut portion, the cuts and uncut portions being located alternately so as to intersect the corrugations al of the corrugated cardboard, and an additional cut portion a5 of a shorter length located at the end of each cut portion a3 and inclined toward the non-cut portion a4 adjacent the associated cut portion a3.

According to the method of the eleventh embodiment, in case that the sheet a is a corrugated cardboard, directional permanency of folding can be imparted to the sheet a without causing breaking of the sheet a at the folds when it is folded along the folding ruled lines a2.

A method of imparting directional permanency of folding to a sheet according to a 12th embodiment of the present invention is an adaption of the first or the fifth embodiment to a pasteboard sheet, wherein at least some of the ruled lines a2 are pressed lines formed on the sheet a by a press or intermittent cutting lines formed on the sheet a by cutting.

The method of imparting directional permanency of folding to a sheet according to the 12th embodiment makes the formation of the folding ruled lines a2 easier, when the sheet a is pasteboard.

In order to attain the aforementioned objects of the present invention, an apparatus for imparting directional permanency of folding to a sheet according to the present invention is as follows.

An apparatus for imparting directional permanency of folding to a sheet according to the 13th embodiment of the present invention comprises:

a plurality of folding working tools which are located at predetermined intervals so as to face the sheet a, located at a working position, alternately from opposing sides of sheet, and have distal ends directed toward the sheet a along folding ruled lines a2 formed on the sheet orthogonal to its longitudinal dimension, folding drive means for moving a first plurality of the working tools, e.g. lower working tools, perpendicular to one side of the sheet a until the sheet a is bent to some extent along the respective folding ruled lines and then returns the working tools to their initial positions, shuttle drive means for moving one plurality of folding working tools from one side of the working position, in the direction of sheet conveyance, toward an opposite side of the working position, so as to shorten the distances between the respective folding working tools 21–26,31–36 at a uniform ratio and returns the working tools to the one side, and advancing drive means for moving a second plurality of the respective folding working tools away from or back to a position facing a second sheet surface.

The method of the present invention can be performed smoothly and surely by this apparatus for imparting directional permanency of folding to a sheet, because, when the sheet a is folded by the folding drive means 4, the respective folding working tools 21–26,31–36 are moved from their initial positions toward one side edge of the sheet a by the shuttle drive means 5.5*a,* 6.6 so that the distances between them are shortened in a uniform ratio from the original distances.

Further, since the apparatus is provided with the advancing drive means 7*a*, 7 which move the respective folding working tools 21–26,31–36 away from or toward the working position at the sheet surface, the sheet a can be handled easily after folded and a control cycle of imparting directional permanency of folding to the sheet can be repeated.

An apparatus for imparting directional permanency of folding to a sheet according to the 14th embodiment of the present invention comprises, in addition to the apparatus components of the 13th embodiment, shifting means for shifting a second plurality of the folding working tools 21–26,31–36 so as to shorten or lengthen the distance between adjacent working tools.

Since the apparatus for imparting directional permanency of folding to a sheet according to the 14th embodiment comprises shifting means 80•81,9 which shifts a second plurality of the folding working tools 21–26,31–36 so as to shorten or lengthen the distance between adjacent working tools, the distances between the folding working tools 21–26,31–36 can be adjusted and the method of the present invention can be performed in the same apparatus by controlling the moving velocity of the folding working tools by the shuttle driving means 5•5*a*, 6•6*a*.

According to the apparatus for imparting directional permanency of folding to a sheet of the 15th embodiment of the present invention, the above-mentioned shifting means 80•81, 9 of the apparatus of the 14th embodiment is provided with screw shafts 80*h*•81*h,* 9*b*, the rotation of which is properly controlled by motors 80*g*•81*g,* 9*a* and screw guides 80*i,* 9*c* through which the screw shafts 80*h*•81*h,* 9*b* extend.

In the apparatus for imparting directional permanency of folding to a sheet according to the 15th embodiment, since the above-mentioned shift means 80.81 and 9 comprises screw shafts 80*h*•81*h,* 9*b* whose rotation is controlled by motors 80*g*•81*g,* 9*a* and screw guides 80*i,* 9*c* through which the screw shafts 80*h*•81*h,* 9*b* extend, the moving velocity of the folding working tools moved by the shuttle drive means 5.5*a*, 6.6*a* can be controlled very easily and the control can be done more accurately.

An apparatus for imparting directional permanency of folding to a sheet according to the 16th embodiment of the present invention further comprises, in addition to the apparatus components of the 13th embodiment, actuators 21*a*–26*a* for all or some of the folding working tools 21–26,31–36 for moving the corresponding folding working tools 21–26,31–36 toward or away from the sheet a independently.

Since the apparatus for imparting directional permanency of folding to a sheet of the 16th embodiment is provided with actuators 21*a*–26*a* for all or some of the folding working tools 21–26,31–36, for moving the corresponding folding working tools 21–26,31–36 toward or away from the sheet a independently, if some working tool(s) is not required for imparting directional permanency of folding to the sheet a, that working tool(s) alone can be retracted.

An apparatus for imparting directional permanency of folding to a sheet according to the 17th embodiment of the present invention further comprises, in addition to the apparatus components of the 13th embodiment, conveying means which supplies the sheet a to the working position 1*b* by transporting it in a direction parallel to its length and the shuttle drive means 5•5*a*, 6•6 move the respective folding working tools 21–26,31–36 in the direction of conveyance by the conveying means so as to shorten the initial distances between the respective folding working tools 21–26,31–36 in a uniform ratio.

The apparatus of the 17th embodiment is very useful for repeating a cycle consisting of conveyance of the sheet and imparting directional permanency of folding to the sheet, since it is provided with the conveying means which supplies the sheet a to the working position 1*b* by transporting it in its longitudinal direction and the shuttle drive means 5•5*a*, 6•6 thereof move the respective folding working tools 21–26, 31–36 in the direction of conveyance by the conveying means so as to shorten the initial distances between the respective folding working tools 21–26,31–36 in a uniform ratio.

An apparatus for imparting directional permanency of folding to a sheet according to the 13th embodiment of the present invention further comprises, in addition to the apparatus of the 13th embodiment, sheet guides 1*h* having many guide bars 1*i* in parallel along the longitudinal dimension of the sheet a at the working position 1*b* of the sheet a and, corresponding to the guide bars 1*i*, many indentations (cut outs) formed at the tips of the respective folding working tools 21–26, 31–36 driven by the folding drive means.

In the apparatus for imparting directional permanency of folding to a sheet of the 18th embodiment, the sheet can be supplied to the working position in a stable state and imparting of directional permanency to the sheet a is performed more smoothly, because of the sheet guides 1*h* and the indentations (cut outs) formed in the tips of the respective folding working tools 21–26,31–36 driven by the folding drive means.

An apparatus for imparting directional permanency of folding to a sheet according to a 19th embodiment of the present invention is an arrangement of the 13th embodiment wherein the sheet a is supplied to the working position 1*b* horizontally and folding working tools 21–26 facing one side of the sheet a are located so as to face the sheet from the under side and folding working tools 31–36 are located so as to face the sheet from the upper side.

In the apparatus for imparting directional permanency of folding to a sheet according to the 19th embodiment, the operation of the respective folding working tools 21–26, 31–36 can be easily controlled and the respective folding working tools 21–26, 31–36 can be operated easily, because the sheet a is supplied to the working position 1*b* horizontally and folding working tools 21–26 are located below the sheet and folding working tools 31–36 are located above the sheet.

The 20th embodiment of the present invention is a modification of the apparatus of the 13th embodiment wherein each of the shuttle driving means 5•5*a*, 6•6*a* comprises at least one pair of sprockets 51*a*•51*b*–56*a*•56*b*, 61*a*•61*b*–66*a*•66*b* corresponding to the respective folding working tools 21–26,31–36, endless timing belts or chains 51–56, 61–66 mounted on the pairs of sprockets 51*a*•51*b*–56*a*•56*b*, 61*a*•61*b*–66*a*•66*b* and supporting the corresponding folding working tools 21–26,31–36, and pairs of guide rails 51*d*–56*d*, 61*d*–66*d* which guide the respective folding working tools 21–26, 31–36 when they are moved, and at least, the pairs of sprockets 51*a*•51*b*–56*a*•56*b* corresponding to the respective folding working tools 21–26 facing one side of the sheet a and the pairs of sprockets 61*a*•61*b*–66*a*•66*b* corresponding to the respective folding working tools 31–36 facing the other side of the sheet a, are driven separately by different motors 5*b*•5*c*•6*b*•6*c*, respectively, to make the circumferential velocities of the timing belts or chains 51–56, 61–66 different.

According to an apparatus for imparting directional permanency of folding to a sheet of the 20th embodiment, movement of the respective folding working tools 21–26, 31–36 can be controlled very easily to shorten the initial distances between them in a uniform ratio, because the shuttle drive means 5•5*a*, 6•6*a* are provided with one pair of sprockets 51*a*•51*b*–56*a*•56*b*, 61*a*•61*b*–66*a*•66*b* corresponding to the respective folding working tools 21–26, 31–36, endless timing belts or chains 51–56, 61–66 mounted on the pairs of sprockets 51*a*•51*b*•56*a*•56*b*, 61*a*•61*b*–66*a*•66*b* and supporting the corresponding folding working tools 21–26, 31–36, and the circumferential velocity of each of the timing belts or chains 51–56, 61–66 is different.

In addition, since the apparatus is provided with pairs of guide rails 51*d*–56*d*, 61*d*–66*d* which guide the respective folding working tools 21–26, 31–36 when they are moved, the respective folding working tools 21–26, 31–36 can be moved in a stable state.

Therefore, directional permanency of folding can be added to the sheet a more smoothly, accurately and on an industrial scale.

The apparatus for imparting directional permanency of folding to a sheet of the 21st embodiment of the present invention is a modification of the 13th embodiment wherein all or some of the folding working tools 21–26 and 31–36 have their tips thereof lying along the adjacent folding ruled lines a2 in the sheet a.

The moving velocities of some of working tools need not be corrected when directional permanency of folding is imparted to the sheet a along the pairs of the folding ruled lines a2, because the tips of all or some of the folding working tools 21–26 and 31–36 lie along the adjacent folding ruled lines a2 in the sheet a.

The apparatus for imparting directional permanency of folding to a sheet of the 22nd embodiment of the present invention is a modification of the apparatus of the 13th embodiment wherein main parts 24*b*, 32*b* of the folding working tools 21–26 and 31–36, except for at least base parts 24*c*, 32*a* thereof, are exchangeably connected to the base parts 24*c*, 32*a*.

In the apparatus of the 22nd embodiment, the main parts 24*b*, 32*b* can be easily exchanged because they are exchangeably connected to the base parts 24*c*, 32*a*.

The apparatus for imparting directional permanency of folding to a sheet of the 23rd embodiment of the present invention is a modification of the 22nd embodiment wherein main parts 24*b*, 32*b* of the folding working tools 21–26 and 31–36, except for the base parts 24*c*, 32*a*, are composed of plates.

The apparatus of 23rd embodiment is most suitable for imparting directional permanency of folding to a sheet, since the main parts 24*b*, 32*b* of the folding working tools 21–26 and 31–36 are composed of plates.

BRIEF EXPLANATION OF THE DRAWINGS

FIG. 14*a* is a partial side view showing the state that the respective folding working tools are set to the working position after the sheet is supplied there, FIG. 14*b* is a partial side view showing the state wherein directional permanency of folding is being imparted to the sheet and FIG. 14*c* is a partial side view showing the state wherein directional permanency of folding has been imparted to the sheet.

FIGS. 25*a*–25*c* are explanatory views of a method of the 4th embodiment of the present invention, wherein FIG. 25*a* is a partial side view showing the state where the respective folding working tools are set to the working position after the sheet is supplied there, FIG. 25*b* is a partial side view showing the state wherein directional permanency is being imparted to the sheet and FIG. 25*c* is a side view of a part of a block manufactured from the sheet having directional permanency of folding imparted.

DESCRIPTION OF THE PREFERRED EMBODIMENTS

An apparatus for imparting directional permanency of folding to a sheet according to the first embodiment of the present invention will be explained hereinafter with the reference of FIGS. 1–11.

Figure 1:
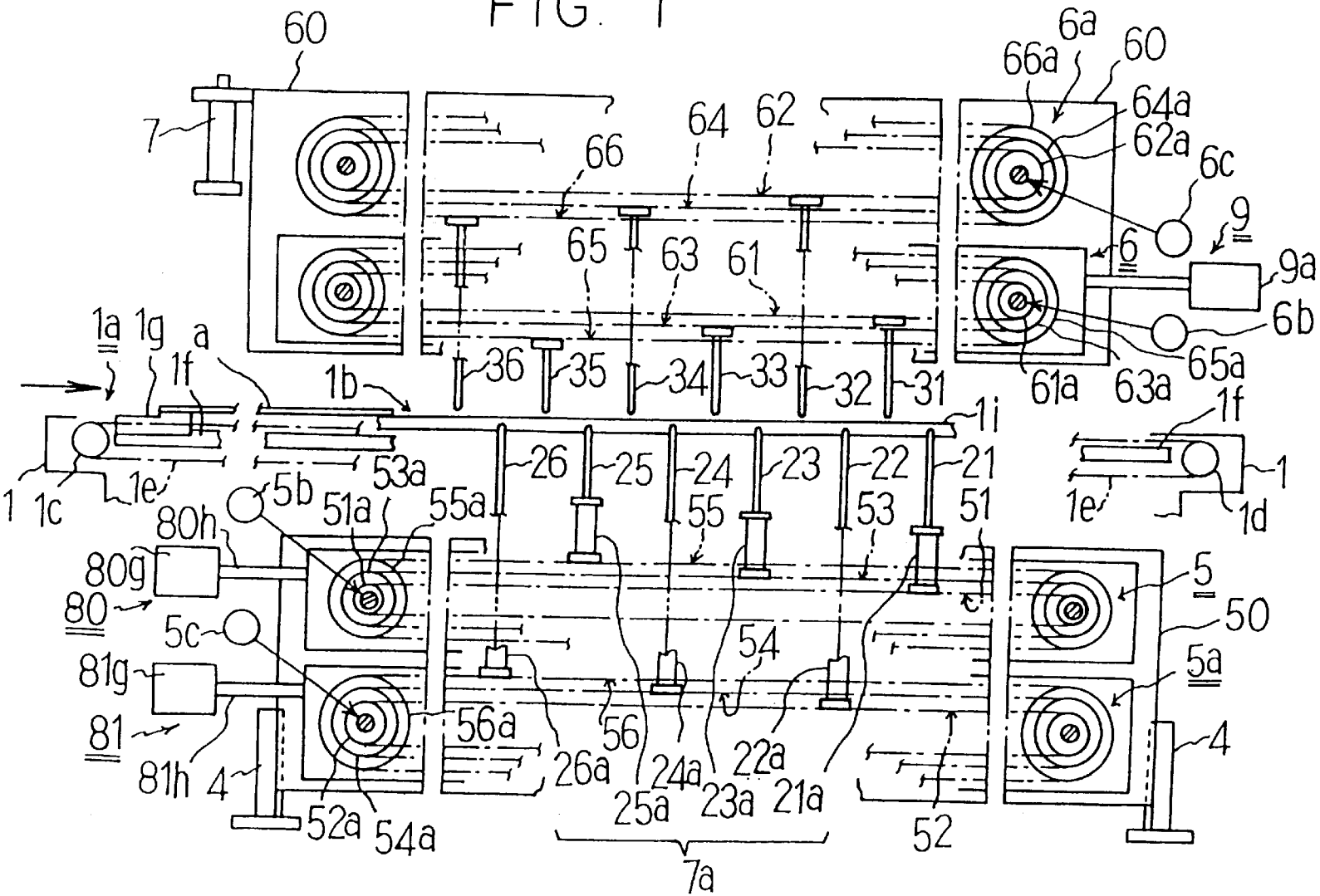
FIG. 1 is a schematic side view of the essential parts of the apparatus for imparting directional permanency of folding according to the 1st embodiment of the present invention.

Referring now to FIG. 1, an outline of the apparatus of the first embodiment will be explained.

In FIGS. 1, 1*a* is a conveying means for supplying a sheet a almost horizontally from the left side of the drawing to the right side.

Folding working tools consisting of plates 21, 22, 23, 24, 25, 26 and 31, 32, 33, 34, 35, 36 are disposed above and under the working position lb, respectively, so that they face the conveyed sheet a alternately from the under side and the upper side at a constant distance (interval).

The respective folding working tools 21–26 and 31–36 are parallel to each other and their distal ends are approximately orthogonal to the longitudinal dimension of the sheet a.

Beneath the working position 1*b*, a folding drive means 4 is provided which moves the lower working tools 21–26 upwards or downwards through a required distance to fold the sheet a, shuttle drive means 5, 5*a* which move the working tools 21–26 rightwards or leftwards of the drawing at a different velocity and shifting means 80, 81 each of which moves the working tools 21, 23, 25 or 22, 24, 26 rightwards or leftwards of the drawing independently of the shuttle drive means 5.

Above the working position 1*b*, an advancing drive means 7 is provided for raising and lowering the upper working tools 31–36 to and from the position represented by a solid line in FIG. 1. Shuttle drive means 6, 6*a* move the working tools 31–36 rightwards or leftwards of the drawing at a different velocity and shifting means 9 moves the working tools 31, 33, 35 rightwards or leftwards of the drawing independently of the shuttle drive means 6.

Actuators 21*a*, 22*a*, 23*a*, 24*a*, 25*a*, and 26*a*, each consisting of an air cylinder, are connected to the lower working tools 21–26 respectively in order to move them upwards or downwards through a required distance. These actuators 21*a*–26*a* also function as advancing drive means 7*a* which moves the lower working tools 21–26 downwards from the position represented by a solid line to a retracted position and from the retracted position to an advanced position.

In FIG. 1, the lower advancing drive means 5 and 5*a* and the upper advancing drive means 6 and 6*a* are shown in vertical arrangement respectively for the convenience of explanation but, as explained later, they are actually disposed at the same level.

The apparatus of this embodiment will be explained in detail with the reference of FIGS. 1–11 hereafter.

The conveying means la is provided with a pair of pulleys with teeth (sprockets) 1*c*, 1*d* installed in the frame 1, extending along the conveyance direction, timing belts (or chains) 1*e* mounted on the pulleys 1*c*, 1*d* under tension by a tension belt (not shown in the figure) and a vacuum chuck 1*g* connected to the respective timing belts 1*e*. The right hand pulley id is driven by a motor with a decelerator (not shown in the figure).

Figure 2:
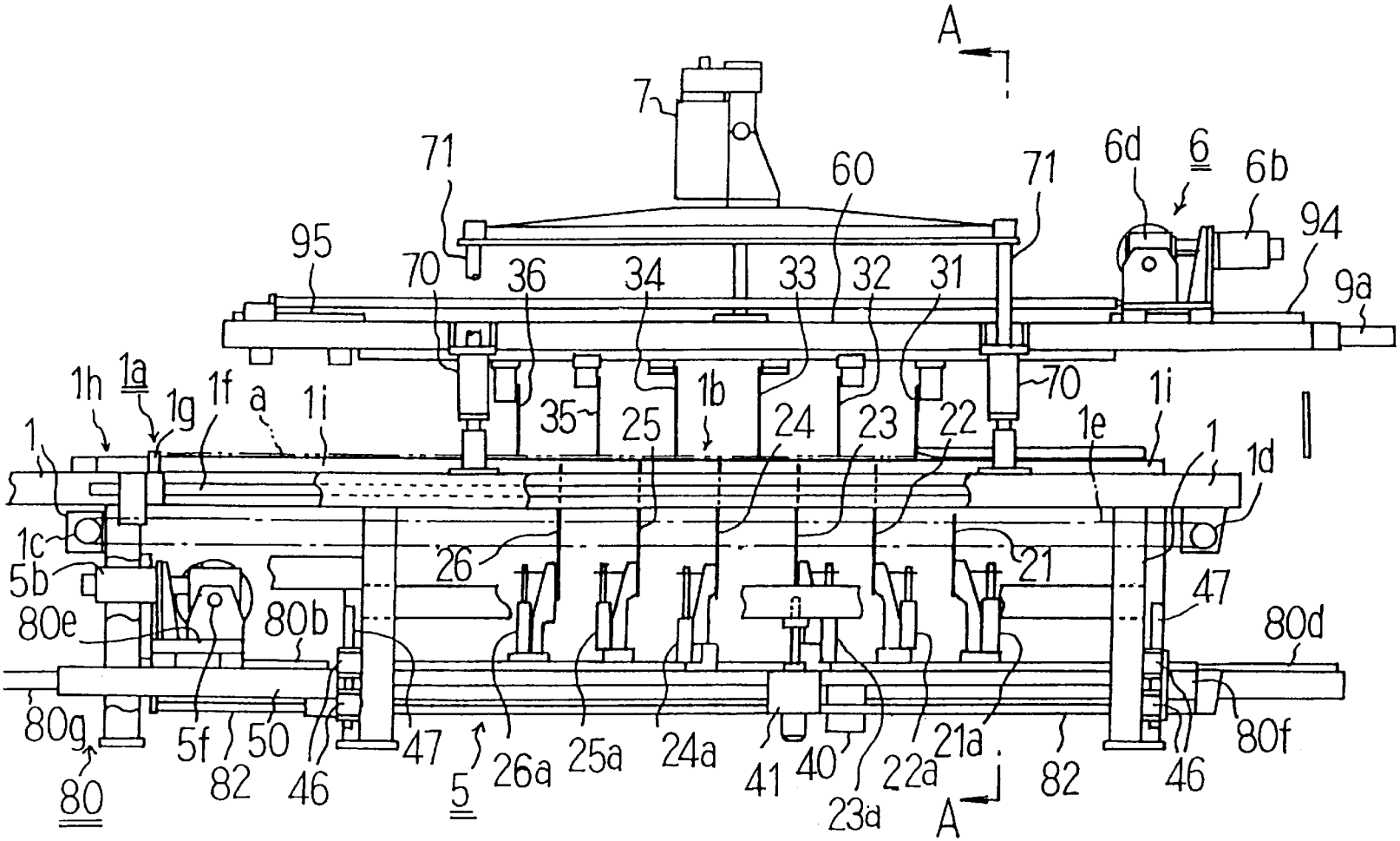
FIG. 2 is a side view of the apparatus of the 1st embodiment, where a part thereof is omitted.
Figure 3:
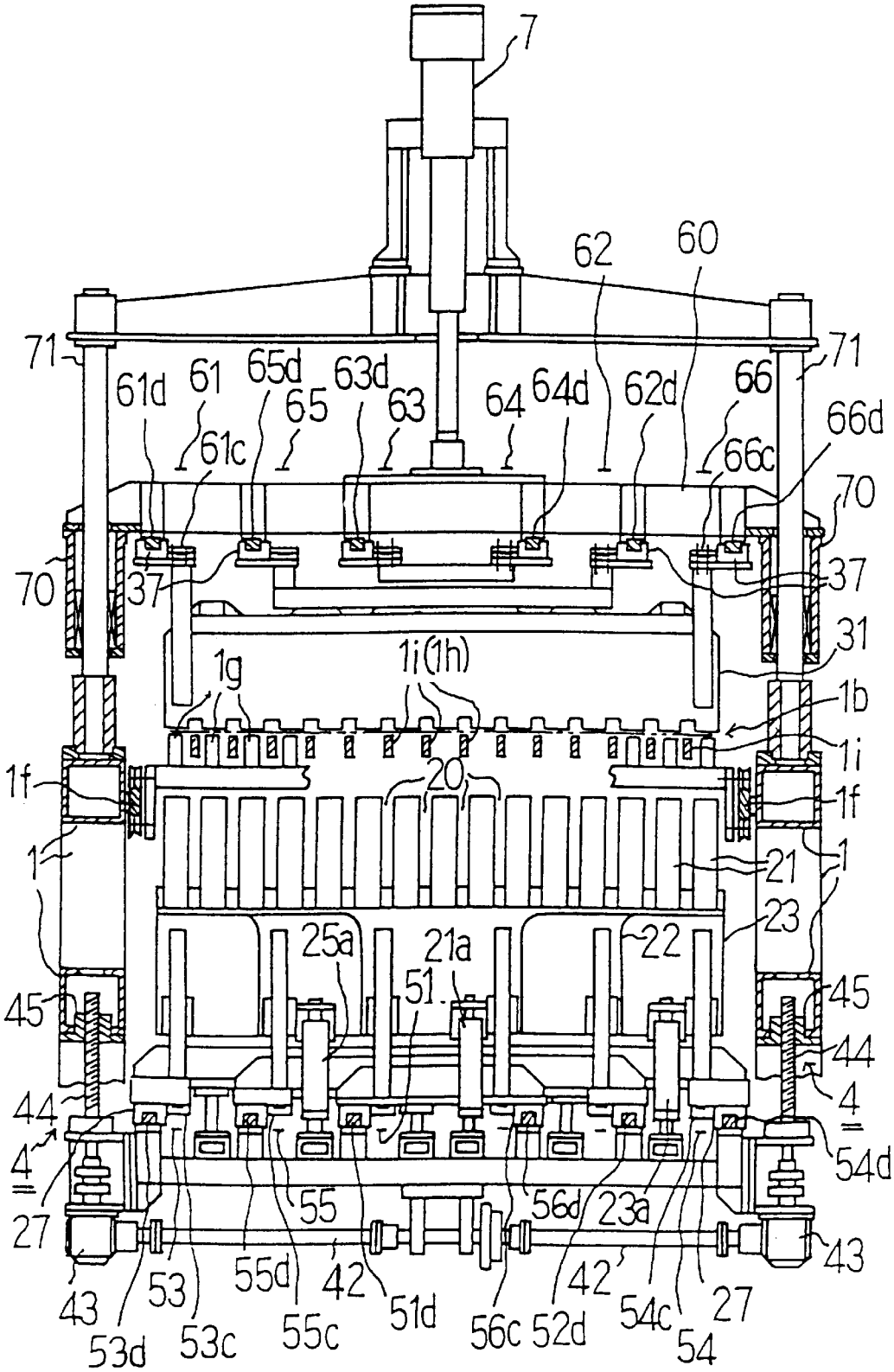
FIG. 3 is an enlarged cross sectional view of the main parts along the arrow A—A of FIG. 2.

The vacuum chucks 1*g* run along guide rails 1*f* which are set in parallel to the respective timing belts 1*e* as shown in FIGS. 1–3, under control of control means (not shown in the figure).

Figure 4:
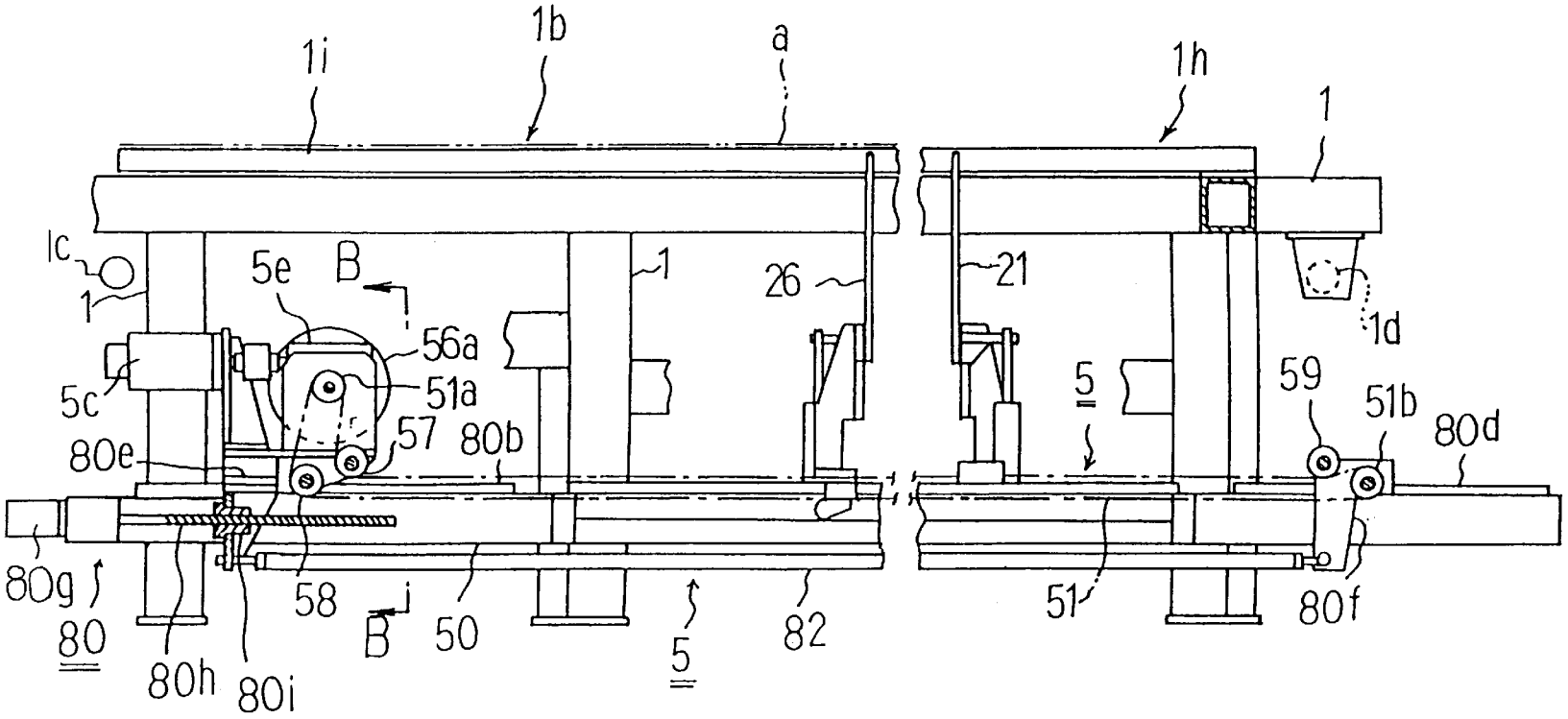
FIG. 4 is a partial side view of a lower part of the apparatus of FIG. 2, the level of which is lower than the working position.

As shown in FIGS. 2–4, a sheet guide 1*h*, which consists of many guide bars 1*i* disposed at a regular interval, is installed at the conveyance level (including working position lb) of the conveying means 1*a* so that the guide extends along the conveyance path defined by conveying means 1*a*.

FIGS. 1–6 show a lower movable frame 50, both sides of which are connected with the folding drive means, and which is moved up and down with a fixed stroke by this folding drive means 4.

The folding drive means 4 consists of a motor 40 shown in FIG. 2, a decelerator 41 connected with the motor 40, a rotation transmitting shaft 42 shown in FIG. 3 which receives the rotation from the decelerator 41, screw shafts 44 connected with the rotation transmitting shaft 42 through rotation conversion means 43, screw guides 45 fixed to the frame 1 and so on. Therefore, the movable frame is moved upwards or downwards by a regular or opposite rotation of the screw shafts 44 which extend through the screw guides 45.

When the movable frame 50 is thus moved upwards or downwards, low friction bodies 46 (FIG. 2), which are connected to the frame 50 at four points, are guided by elevator guides 47 fixed to the prop of the frame 1 to stabilize the motion of the movable frame.

Figure 5:
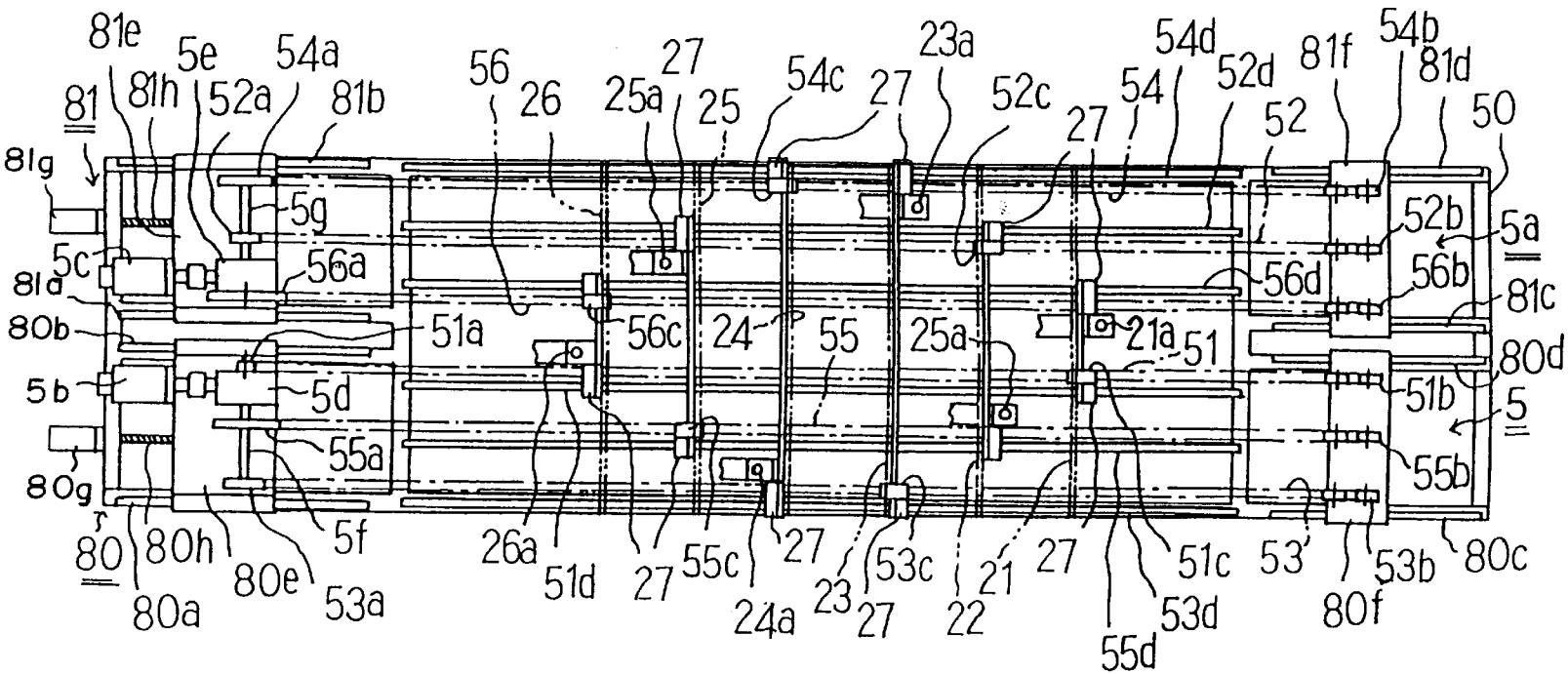
FIG. 5 is a schematic plan view of a shifting mechanism and shuttle drive means in the lower part of the apparatus of FIG. 4.
Figure 6:
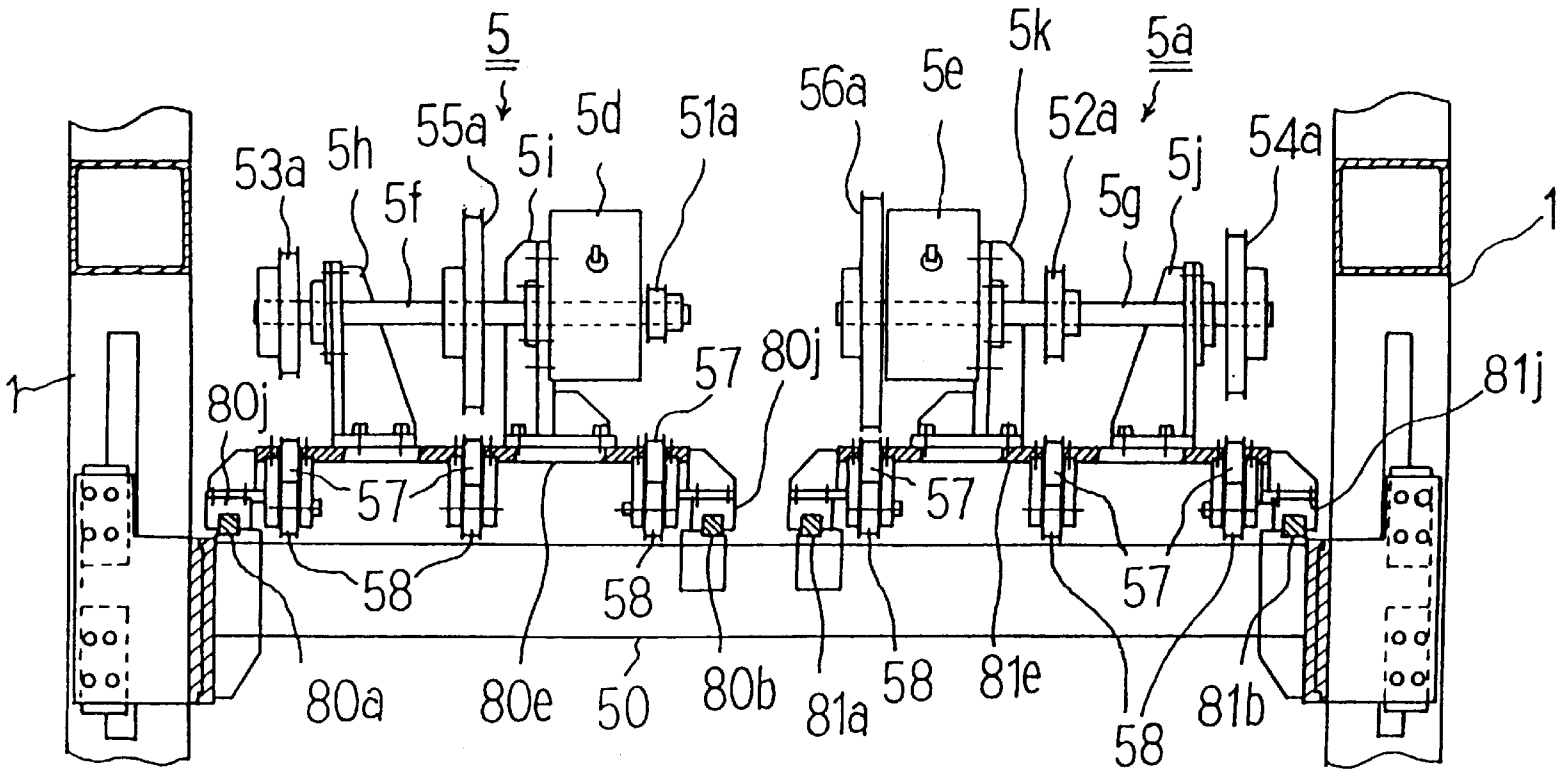
FIG. 6 is an enlarged cross-sectional view of the main parts taken along the arrow B—B of FIG. 4.

The lower shuttling drive means 5 and 5*a* are installed on the movable frame 50 as shown in FIGS. 4–6.

As explained in detail hereinafter, one of the drive means 5 moves the working tools 21, 23, 25 along the level of the working position 1*b* and the other drive means 5*a* moves the working tools 22, 24, 26 along the level of the working position 1*b*.

As shown in FIGS. 5 and 6, on the upper parts of both sides of the movable frame 50, one pair of guide rails 80*a*, 80*b* and guide rails 80*c*, 80*d* and another pair of guide rails 81*a*, 81*b* and guide rails 81*c*, 81*d* are disposed in parallel respectively along the conveyance path defined by the conveying means of FIG. 2.

A pair of movable stands 80*e*, 80*f* is disposed on the one pair of the guide rails 80*a*, 80*b* and guide rails 80*c*, 80*d* so as to run on a linear bearing 80*j* (FIG. 6).

Another pair of movable stands 81*e*, 81*f* is disposed above the other pair of the guide rails 81*a*, 81*b* and guide rails 81*c*, 81*d* so as to run on a linear bearing 81*j* (FIG. 6).

Each pair of the movable stands 80*e*, 80*f* and the movable stands 81*e*, 81*f* is connected with a connecting bar 82 (FIG. 4), respectively, so that each pair moves in unison.

As shown in FIGS. 5 and 6, shafts 5*f*, 5*g*, which are rotated by the motors (servo-motors) 5*b*, 5*c* through the decelerators 5*d*, 5*e*, respectively, are supported by the respective members 5*h*, 5*i* and 5*j*, 5*k* on the sides of the movable stands 80*e* and 81*e*.

Pulleys with teeth (sprockets) 51*a*, 53*a*, 55*a* and pulleys with teeth (sprockets) 52*a*, 54*a*, and 56*a*, each of which has a different diameter (increasing in this order) are installed on the rotary shafts 5*f*, 5*g*, respectively.

Corresponding to the above-mentioned pulleys 51*a*, 53*a*, 55*a*, 52*a*, 54*a* and 56*a*, pulleys with teeth (sprockets) 51*b*, 53*b*, 55*b*, 52*b*, 54*b*, and 56*b* of the same diameter are installed on the other movable stands 80*f* and 81*f* respectively.

Timing belts (or chains) 51, 52, 53, 54, 55, and 56 are run around the pulleys 51*a*, 51*b*, the pulleys 52*a*, 52*b*, the pulleys 53*a*, 53*b*, the pulleys 54*a*, 54*b*, the pulleys 55*a*, 55*b* and the pulleys 56*a*, 56*b* respectively through tension pulleys 57, 58, and 59.

The above-mentioned folding working tools 21, 23, 24, 25, and 26 are connected respectively to the upper runs of the respective timing belts 51, 52, 53, 54, 55, and 56 by connecting pieces 51*c*, 52*c*, 53*c*, 54*c*, 55*c*, and 56*c*.

Guide rails 51*d*, 52*d*, 53*d*, 54*d*, 55*d*, and 56*d* are disposed on the movable frame 50 in parallel and close to the running part of the respective timing belts 51–56. The respective folding working tools 21–26 are pulled by the respective timing belt 51–56, as the rotary shafts 5*f*, 5*g* rotate regularly or in reverse, and run along the guide rails through two linear bearings 27.

In this embodiment, working tools 21 and 26 run along guide rails 51*d* and 56*d*, working tools 22 and 25 run along guide rails 52*d* and 55*d*, and working tools 23 and 24 run along guide rails 53*d* and 54*d* respectively.

The shifting means 80 is composed of the above-mentioned guide rails 80*a*, 80*b*, 80*c*, 80*d*, the movable stands 80*e*, 80*f* connected with each other, a motor 80*g* with a deceleration function, a screw shaft 80*h* rotated by the motor 80*g* and the like.

As shown in FIG. 4, when the screw shaft 80*h* is rotated regularly or in reverse by the motor 80, the screw guide 80*i* threaded on the screw shaft 80*h* moves rightwards or leftwards in the figure together with the movable stands 80*e*, 80*f*. Thereby, the folding working tools 21, 23 and 25 can be shifted together with the shuttle drive means 5 in the left and right direction of the figure over a desired distance, at a desired velocity and at a necessary time.

The other shifting means 81, which is composed of guide rails 81*a*, 81*b*, 81*c*, 81*d*, the movable stands 81*e*, 81*f* connected each other, a motor 81*g* with a deceleration function, a screw shaft 81*h* connected with the motor 80*g* and the like, can shift the folding working tools 22, 24, and 26 in the right and left directions of the figure together with the shuttle drive means 5*a* over a desired distance, at a desired velocity and at a necessary time, similarly to the above-mentioned shifting means 80.

Except for their bases, the lower working tools 21–26 are composed of plates.

Figure 10:
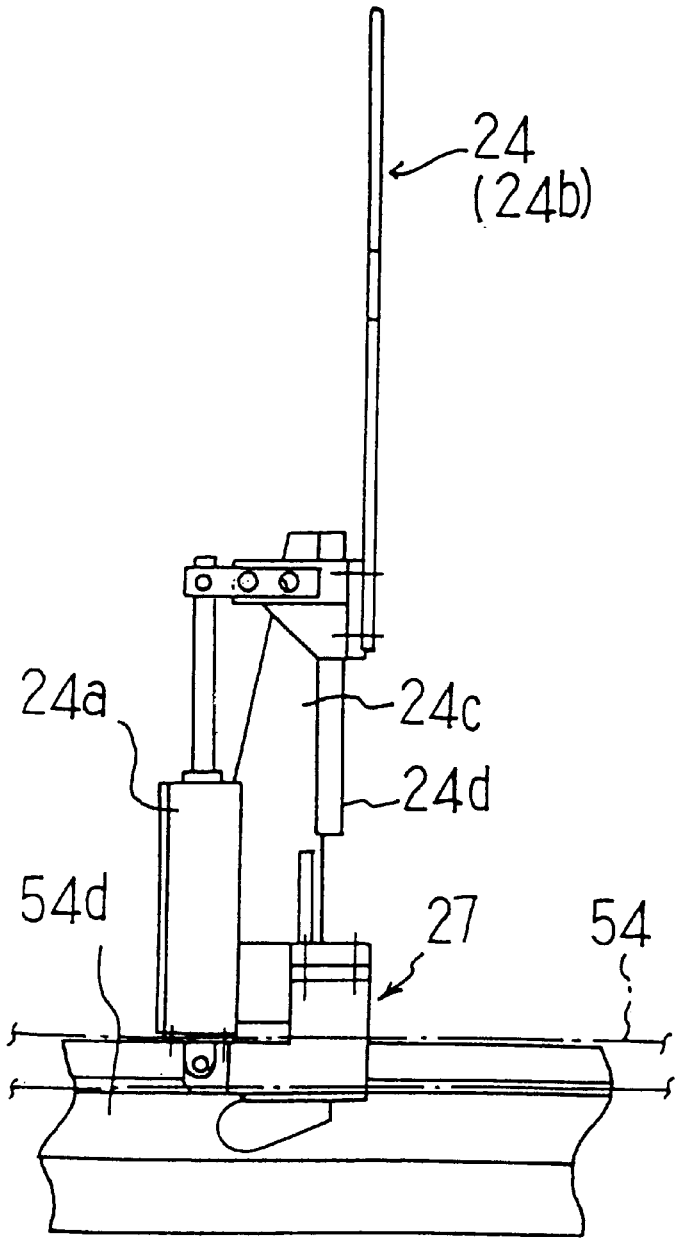
FIG. 10 is an enlarged side view of the lower folding working tool.

As shown in FIG. 10, where an enlarged folding working tool 24 is shown, the main part 24*b* composed of a plate is connected on the frame-like base 24*c* by a screw (not show in the figure) and the base 24*c* is fixed to the housing of the linear bearing 27 by a screw. Actuator 24*a* consisting of an air cylinder is attached to the side of the base 24*c*. The main part 24*b* is raised along the guide 24*d* by operation of the actuator 24*a* to a position where the tip (distal end of 24*b*) is located just beneath the working position 1*b* of FIG. 2.

Other folding working tools 21, 22, 23, 25, and 26 have approximately the same construction as the above-described working tool 24.

Each of the folding working tools 21–26 has cut-outs 20 at positions corresponding to the guide bars 1*i* so that the distal end thereof does not contact the guide bars 1*i* constituting the sheet guide 1*h*, when tools 21–26 are raised by the folding drive means 4 shown in FIG. 3.

The upper movable frame 60, as shown in FIGS. 2 and 3, is moved up and down in a stable state by the advancing drive means 7 consisting of an air cylinder connected to the upper center, as four elevator bodies 70 depending from the bottom of the upper frame 60 are guided respectively by the respective guide posts 71 fixed on the frame 1.

Figure 7:
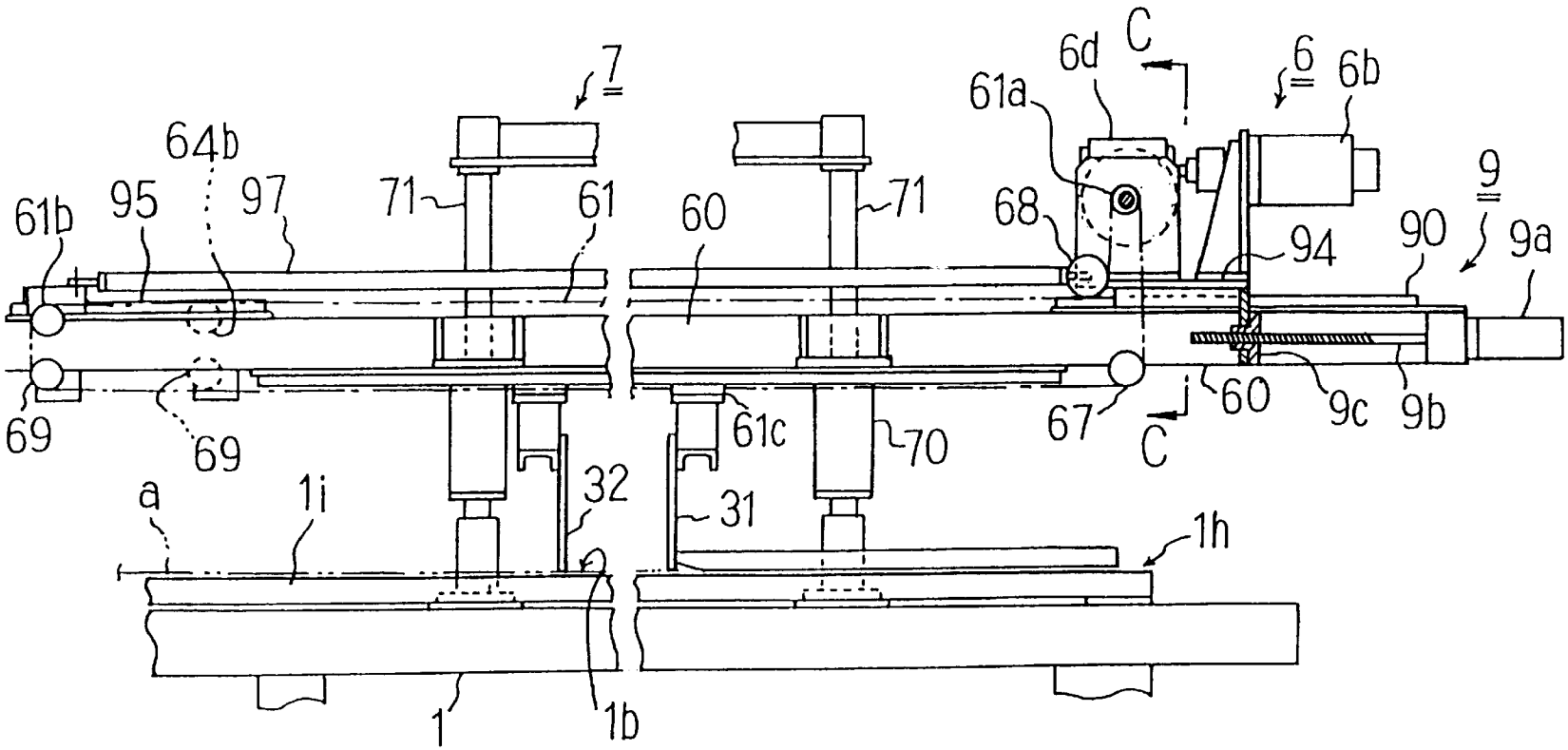
FIG. 7 is a schematic side view of an upper part of the apparatus of the 1st embodiment, the level of which is higher than the working position.
Figure 8:
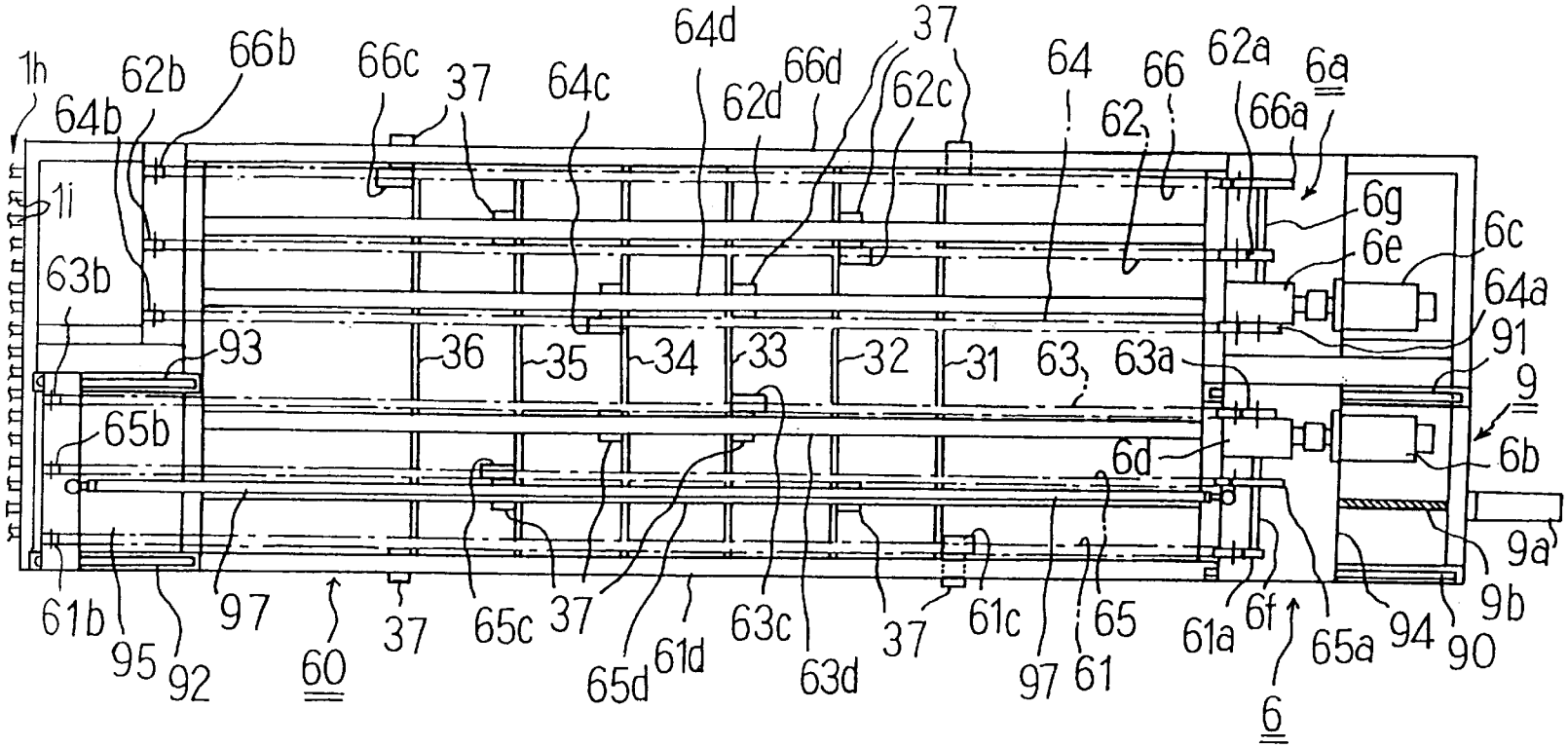
FIG. 8 is a schematic plan view of a shifting mechanism and shuttle drive means in the upper part of the apparatus of the 1st embodiment.
Figure 9:
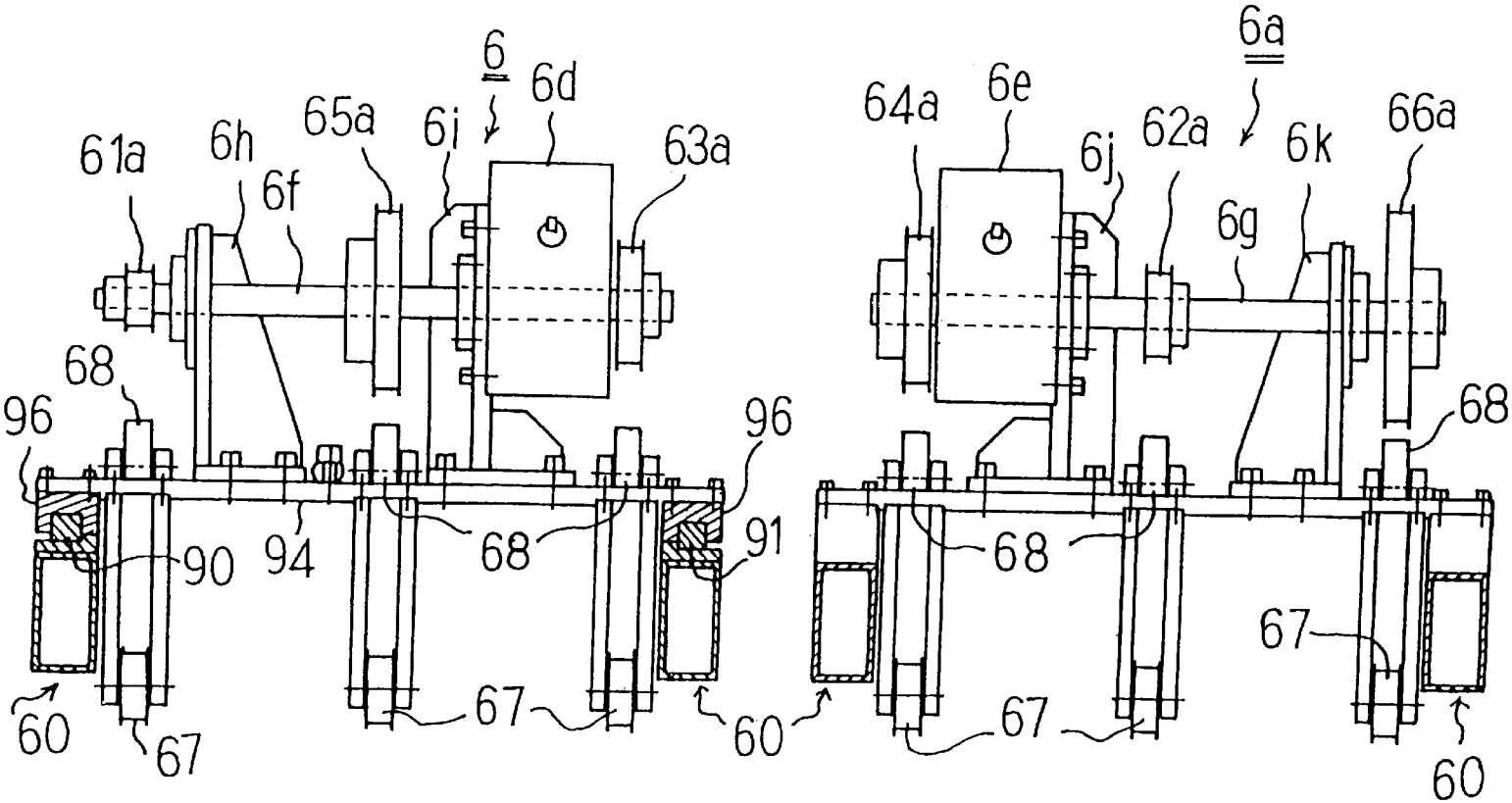
FIG. 9 is an enlarged cross-sectional view of the main parts along the arrow C—C of FIG. 7.

As shown in FIGS. 7–9, the upper shuttle drive means 6, 6*a* are disposed on the movable frame 60 and, as explained in detail hereinafter, one of the drive means 6 shuttles the folding working tools 31, 33, 35 and the other of the drive means 6*a* shuttles the folding working tools 32, 34, 36.

Two pairs of guide rails 90, 91 and 92, 93 are provided in parallel respectively along the conveyance direction of the conveying means 1*a* of FIG. 2 on front side of the upper part of both sides of the movable frame 60.

Movable stands 94, 95 connected mutually by a connecting bar 97 are disposed on the guide rails 90, 91 and 92, 93 so as to slide through a linear bearing 96 (FIG. 9) As shown in FIGS. 8 and 9, rotary shafts 6*f*, which are rotated by the motors (servo-motors) 6*b* through the decelerators 6*d*, are supported by the respective bearing members 6*h*, 6*i* on one of the movable stands 94.

A rotary shaft 6*g* rotated by the motors (servo-motors) 6*c* through the decelerators 6*e* is supported by the respective members 6*i*, 6*k* on the above-mentioned movable stand 94 on the upper part of the movable frame 60.

Pulleys with teeth (sprockets) 61*a*, 63*a*, 65*a* of different diameters (increasing in order), and pulleys with teeth (sprockets) 62*a*, 62*a* and 66*a* of different diameters (increasing in order) are installed on the rotary shafts 6*f*, 6*g*, respectively, on movable stand 94.

Corresponding to the above-mentioned pulleys 61*a*, 63*a*, 65*a* and pulleys with teeth (sprockets) 61*b*, 63*b*, 65*b* of the same diameter are respectively installed on the other movable stand 95. Above the upper part of the frame 30, close to the movable stand 95, pulleys with teeth (sprockets) 62*b*, 64*b*, and 66*b* of the same diameter are respectively installed corresponding to the pulleys with teeth 62*a*, 64*a* and 66*a*.

Timing belts (or chains) 61, 62, 63, 64, 65, and 66 are respectively mounted on the pulleys with teeth 61*a*, 61*b*, the pulleys with teeth 62*a*, 62*b*, the pulleys with teeth 63*a*, 63*b*, the pulleys with teeth 64*a*, 64*b*, the pulleys with teeth 65*a*, 65*b* and the pulleys with teeth 66*a*, 66*b* through respective tension pulleys 67, 68, and 69.

The above-mentioned folding working tools 31, 33, 34, 35 and 36 are connected respectively to the lower runs of the respective timing belts 61, 62, 63, 64, 65 and 66 with connecting pieces 61*c*, 62*c*, 63*c*, 64*c*, 65*c* and 66*c*.

As shown FIGS. 3–8, guide rails 61*d*, 62*d*, 63*d*, 64*d*, 65*d* and 66*d* are disposed on the movable frame 60 in parallel and close to the respective timing belts 61–66. The respective folding working tools 31–36 are moved by the respective timing belt 61–66, as the rotation shafts 6*f*, 6*g* rotate regularly or in reverse, and run along the associated guide rails on linear bearings 37.

In this embodiment, folding working tools 31 and 36 run along guide rails 61*d* and 66*d*, working tools 32 and 35 run along guide rails 61*d* and 66*d*, and working tools 33 and 34 run along guide rails 63*d* and 64*d*, respectively.

In this embodiment, the lower shuttle drive means 5, 5*a* and the upper shuttle drive mean 6, 6*a* operate synchronously and diameters of the respective pulleys 51*a–*56*a* and 61*a–*66*a* increase in the order of 51*a*, 61*a*, 52*a*, 62*a*, 53*a*, 63*a*, 54*a*, 64*a*, 55*a*, 65*a*, 56*a*, 66*a*.

Accordingly, as for the velocity of movement in the horizontal direction of the respective working tools 21–26 and 31–36, the velocity of the working tool 21 positioned on the right end of FIG. 2 is the smallest and that of the working tool 36 positioned on the left end of FIG. 2 is the largest. In addition, the speed of movement in the horizontal direction of the working tool 36 on the left end is set to be same as the conveyance speed of the conveying means 1*a*.

The shifting means 90 is composed of the above-mentioned guide rails 90, 91, 92, 93, the movable stands 94, 95 connected to each other, a motor (servo-motor) 9*a* with a deceleration function, a screw shaft 9*b* rotated by the motor 9*a* and the like.

As shown in FIGS. 7 and 8, when the screw shaft 9*b* is rotated regularly or in reverse by the motor 9*a*, the screw guide 9*c*, through which the screw shaft 9*c* penetrates, moves rightwards or leftwards in FIGS. 7 and 8 thereby driving the movable stands 94, 95. The folding working tools 31, 33 and 35 are thereby shifted together with the shuttle drive means 6 in the left and right direction of the figures through a desired distance, at a desired velocity and at a necessary time.

The main portions of the respective upper folding working tools 31–36, except for the bases, are plates, similar to the lower folding working tools 21–26.

Figure 11:
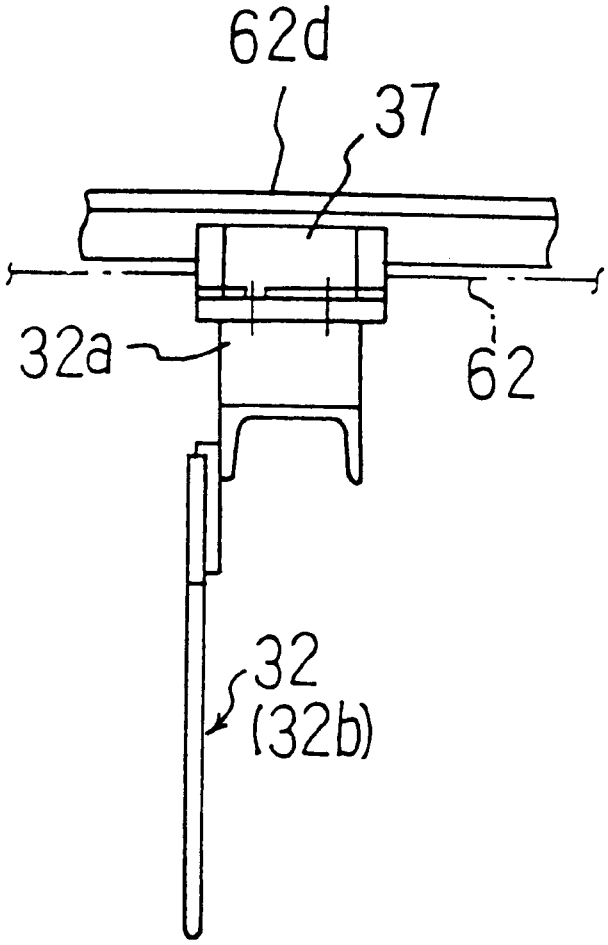
FIG. 11 is an enlarged side view of the upper folding working tool.

FIG. 11 shows an enlarged view of the folding working tool 32. The main part 32*b* consisting of the plate is connected to the tip of the frame-like base part 32*a* by screws and the base part 32*a* is fixed to the housing of linear bearing 37 by screws. The other folding working tools 31, 33–36 are similar to the working tool 32.

These folding working tools 31–36 are moved up and down from a position represented by a solid line of FIG. 2 and FIG. 3 to a predetermined level by the above-mentioned advancing drive means 7.

1st Embodiment of the Method for Imparting Directional Permanency of Folding to a Sheet The first embodiment of the method of imparting directional permanency of folding to a sheet according to this invention will be explained in terms of operation of the respective components of the apparatus of the 1st embodiment with reference to FIGS. 1, 12 and 14–17.

Figure 12:
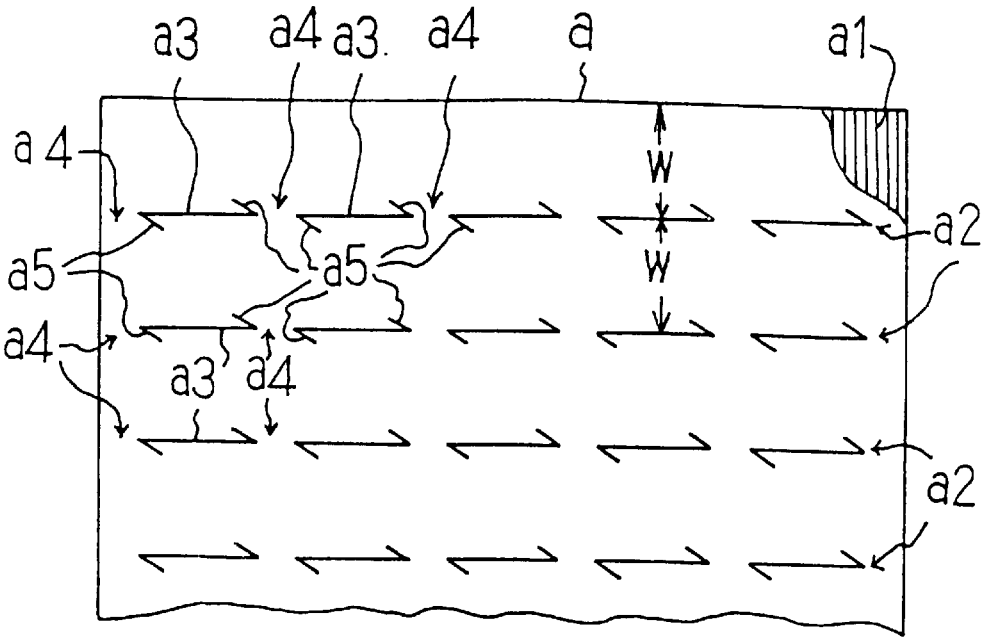
FIG. 12 is a plan view of a part of the sheet used for the method of imparting directional permanency of folding according to the first embodiment of the present invention.

The sheet a used in this embodiment is a B type corrugated cardboard formed with many ruled lines a2 in parallel with a spacing W of 150 mm and oriented approximately orthogonal to the corrugation al as shown in FIG. 12.

Each of the folding ruled lines a2 is composed of a cut portion a3 of a predetermined length formed on the sheet by cutting and a non-cut portion a4 of a shorter length than the cut portions a3. The cut and non-cut portions alternate and are oriented so as to intersect the corrugations al. An additional cut portion a5 of a shorter length is formed at the end of each cut portion a3 inclined toward the non-cut portion a4 adjacent to the cut portion a3.

The additional cut portion a5 serves to prevent the original corrugated cardboard sheet a from tearing at the end of the cut portion a3 in the direction across the cut portion a3 when the sheet a is folded along the folding ruled line a2.

Although the additional cut portion a5 is formed on only one side of the end of the cut portion a3 in this embodiment, when the sheet a is a thicker sheet such as an A type corrugated cardboard, the additional cut portion a5 is preferably formed extending in both longitudinal directions from each end of the cut portion a3 and forms an arrow shape at the ends of the cut portion a3, rather than a one-sided arrow.

Although the folding ruled lines have the non-cut portions a4 located at the side edges of the sheet a in this embodiment, the folding ruled lines a2 may be formed so that cut portions are located on the side edges of the sheet a depending on the application for which the product formed from the sheet a is intended.

By the operation of the shuttle drive means 5, 5*a*, 6, 6*a*, the distances between the respective folding working tools 21–26 and the distances between the respective folding working tools 31–36 are adjusted to be 300 mm, respectively, or the distances between the lower folding working tools 21–26 and the upper folding working tools 31–36 are adjusted to be 150 mm, respectively.

In addition, the lower shuttle drive means 5, 5*a* and the upper shuttle drive means 6, 6*a* are adjusted so that, when the moving velocity of the beginning (leading) folding working tool 21 is 175 to the right in the drawing, the moving velocities of the other lower folding working tools 22–26 become 225, 275, 325, 375, 425, respectively, and the moving velocities of the upper folding working tools 31–36 become 200, 250, 300, 350, 400, 450 respectively.

Before starting of working process, the respective lower working tools 21–26 are located at retracted positions lower than the position represented by a solid line of FIG. 1 and the respective upper working tools 31–36 are located at retracted positions higher than the position represented by a solid line of the drawing.

The sheet a is supplied to the working position 1*b* by the conveying means 1*a* with each folding ruled line a2 being orthogonal to the direction of conveyance by the conveying means 1*a*.

Figure 14A:
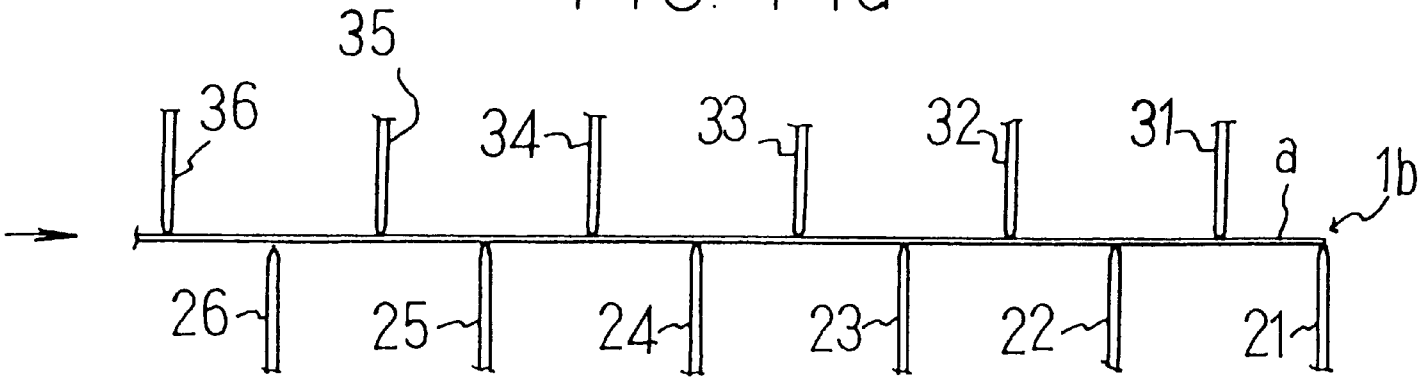
FIGS. 14*a*–14*c* are schematic views showing the relationship of the sheet and the respective folding working tools in the method of the first embodiment of the present invention, where
Figure 14C:
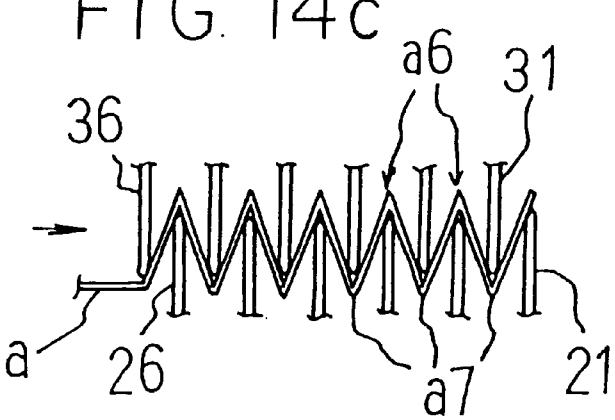
Figure 14B:
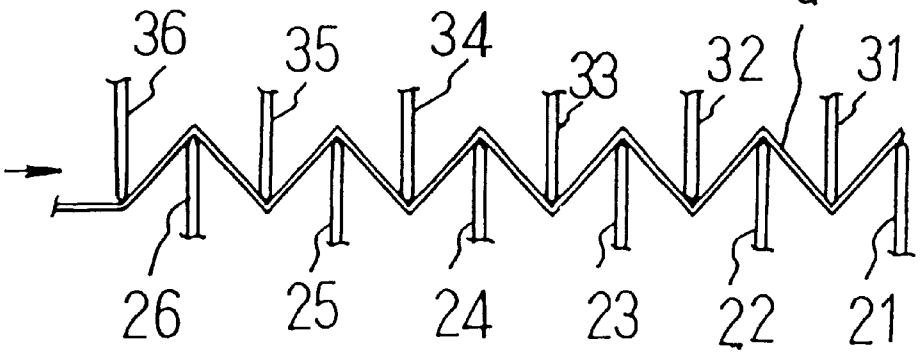

After the sheet a is supplied to the working position lb, the upper advancing drive means 7 and the actuators 21*a*–26*a* consisting the lower advancing drive mean 7*a* are operated so that the respective working tools 31–36 and 21–16 are set at a level in the vicinity of or in contact with the sheet a as shown in FIG. 14.

In this state, the tip of the leading working tool 21 is controlled for location along the leading end of the sheet a and the tips of the other working tools 22–26 and 31–36 are controlled to be located along the folding ruled lines a2, respectively.

Then, the lower folding working tools 21–26 are simultaneously and gradually raised by approximately 140 mm by the operation of the folding drive means 4 and at the same time the respective working tools 21–26 and 31–36 are simultaneously moved rightward in FIG. 14 by the operation of the lower shuttle drive means 5, 5*a* and the upper shuttle drive means 6, 6*a*. At that time, the vacuum chuck 1*g* of the conveying means 1*a* also moves in the same direction as the last working tool 36 and at the same velocity.

Since the ratio of the moving velocities of the respective working tools 21–26 and 31–36 is set as previously mentioned and the respective working tools 21–26 and 31–36 are moved in the right direction to shorten the initial distances at a uniform ratio, the sheet a is folded, from a posture shown in FIGS. 14(*a*) to (*c*) through (*b*), so that ridge-like folds a6 and valley-like folds a7 are alternately formed along the respective folding ruled lines a2.

After the sheet a is folded in a zigzag fashion as shown in FIG. (c) the vacuum chuck 1*g* of the conveying means 1*a* and the respective working tools 21–26 and 31–36 stop moving.

Next, the respective working tools 21–26 are moved downward to their rest position by the advancing drive means 7*a* and the respective working tools 31–36 are raised to their rest position by the advancing drive means 7.

Afterwards, the thus folded sheet a is held between a pair of belt conveyers (not shown in the drawing) for example, and conveyed to subsequent operations while fully extended flat. The respective working tools 21–26 and 31–36 are returned to their initial positions by the shuttle drive means 5, 5*a* and 6, 6*a*.

Figure 15:
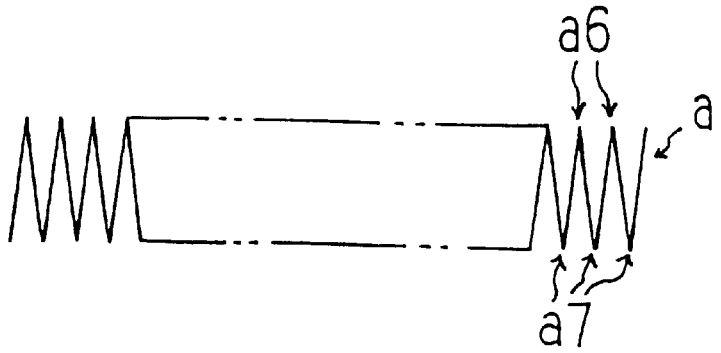
FIG. 15 is a side view of the sheet having directional permanency of folding imparted according to the 1st embodiment of the present invention.
Figure 16:
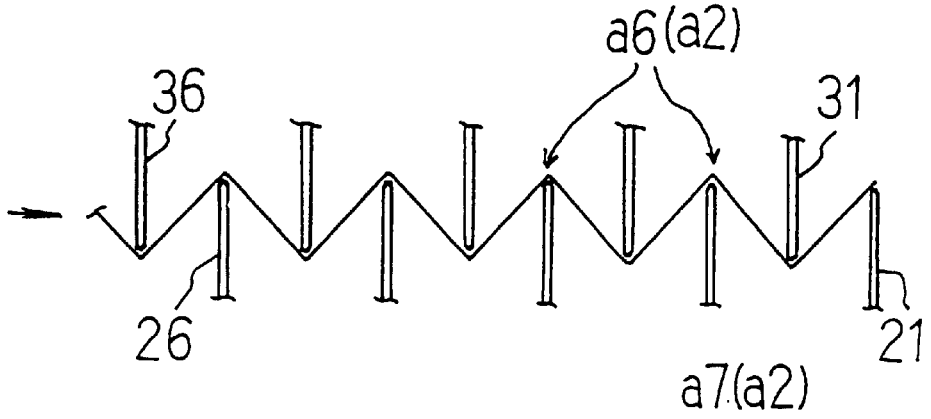
FIG. 16 is a partial side view of another version of the 15t embodiment of the present invention, showing the relationship between the respective folding working tools and the sheet in the state wherein directional permanency is being imparted.
Figure 17:
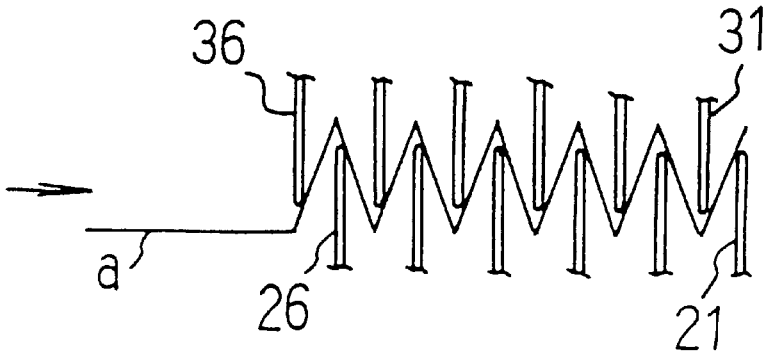
FIG. 17 is a partial side view showing the state wherein directional permanency of folding has been imparted to the sheet.

When the length of sheet a is long, the sheet a is folded into the state shown in FIG. 15 by repeating the cycle of the abovementioned operation of the apparatus of FIG. 1. In this case, the processed part of the sheet a, to which directional permanency of folding has already been imparted, is preferably received by a pair of belt conveyers as described above at every cycle of the operation of the apparatus of FIG. 1.

The sheet a processed as mentioned above is conveyed to a pasting process in the extended (flat) state, where both sides of at least the folded parts a6, a7 are pasted, and further conveyed to a folding station not shown in the drawing.

Employing a folding device after pasting the sheet a, in which the ridge-like folds a6 and valley-like folds a7 are formed alternately along the folding ruled lines a2 by the method of the above-mentioned embodiment, the sheet a is folded along the folds a6, a7 into a square block, accurately and according to the design.

Although the lower folding working tools 21–26 are raised (shifted) to the limit in folding of the sheet a as shown in FIG. 14(*d*), it is sufficient for them to be raised until the sheet a is bent along the folding ruled lines a2 to some extent (at least 90°, preferably 9° or less). If the sheet a is folded along the folding ruled lines a2 to some extent, then the sheet a can be further folded as the respective working tools 21–26 and 31–36 move and thereby be imparted complete directional permanency of folding.

Figure 18:
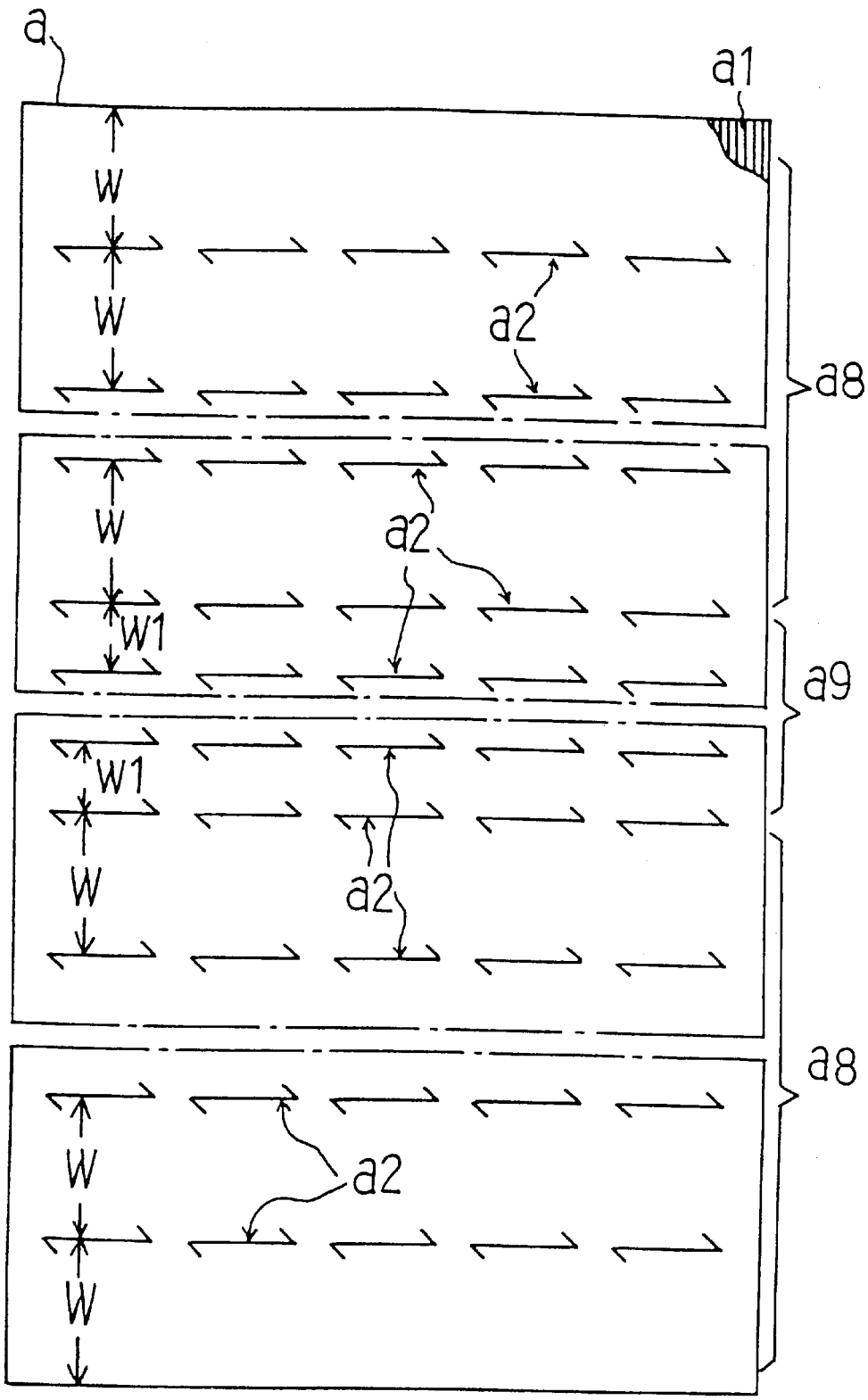
FIG. 18 is a plan view of a part of the sheet used in the method of the 2nd embodiment of the present invention.

2nd Embodiment of the Method of Imparting Directional Permanency of Folding to a Sheet The sheet used in this embodiment is a B type corrugated cardboard, in which many folding ruled lines a2 similar to that of the 1st embodiment are formed orthogonal to the corrugations al as shown in FIG. 18. The sheet is longitudinally divided into a central part a9, in which the folding ruled lines a2 have a longitudinal spacing w1 of 50 mm, and parts a8, on both sides of the part a9, in which the folding ruled lines a2 have a longitudinal spacing w of 100 mm.

The distances between the working tools 21–26 and 31–36 are adjusted to be 100 mm by moving the working tools 21–26 and 31–36 somewhat to the right in the drawing by operating the upper and lower shuttle drive means 5, 5*a*, 6, 6*a* of the apparatus of FIG. 1.

Then the leading sheet part a8 is folded along the folding ruled lines a2 by operating the apparatus in the same manner as that of the 1st embodiment.

Next, when the sheet part a9 is to be folded, the distances between the working tools 21–26 and 31–36 are adjusted to 50 mm by operating shuttle drive means 5, 5*a*, 6, 6*a* and the operation of the apparatus is repeated as in the 1st embodiment.

When the posterior sheet part a8 is to be folded, the apparatus is operated after adjusting the distances between the working tools 21–26 and 31–36 in the above-mentioned manner.

Figure 19:
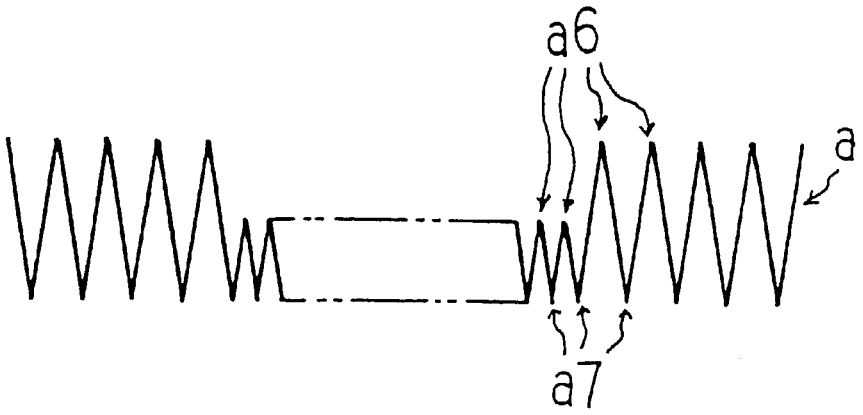
FIG. 19 is a schematic side view showing the state wherein directional permanency has been imparted to the sheet shown in FIG. 18.

The sheet a, to which directional permanency of folding is imparted as mentioned above, is folded in zigzag as shown in FIG. 19. That is, a corrugated cardboard block of an approximately square gutter shape is produced by conveying the sheet a to the pasting process while extended (flat) and, after pasting, folding it by the folding device.

Otherwise, the method according to this embodiment is similar to that of the 1st embodiment.

3rd Embodiment of the Method of Imparting Directional Permanency of Folding to a Sheet The third embodiment of the method of imparting directional permanency of folding to a sheet according to this invention will be explained together with the operation of the apparatus of the above-mentioned embodiment with reference to FIGS. 1, 13 and 20–23.

Figure 13:
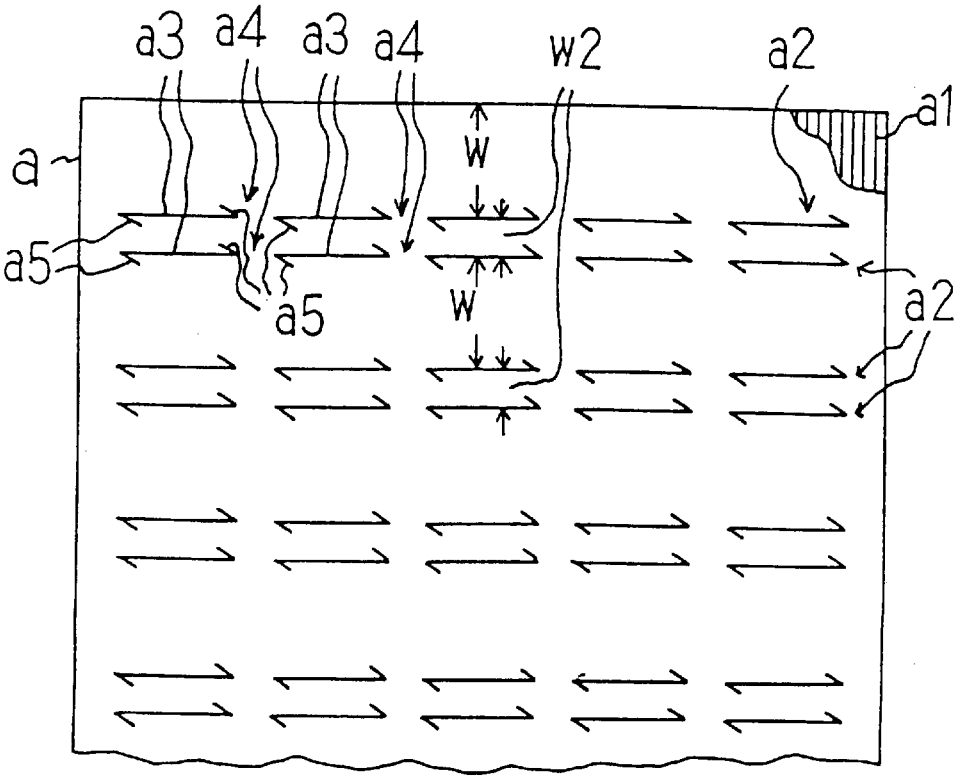
FIG. 13 is a plan view of a part of the sheet used for the method of imparting directional permanency of folding according to the third embodiment of the present invention.

The sheet a used in this embodiment is a B type corrugated cardboard, in which pairs of two folding ruled lines a2, a2 are formed in parallel at distances w of 90 mm as shown in FIG. 13.

The folding ruled lines a2 have the same design as those of the first embodiment and are formed approximately orthogonal to the corrugations al. The distance w2 between folding ruled lines a2, a2 of the pair is 30 mm.

By operating the shifting means 80, 81 and 9, and the shuttle drive means 5, 5*a*, 6, 6*a* of the apparatus of FIG. 1, the distances between the tips of the lower working tools 21 and 22, 22 and 24, 25 and 26, and the upper working tools 32 and 33, 34 and 35 are adjusted to be 30 mm and the distances between the tips of the working tools 31 and 21, 22 and 32, 33 and 23, 24 and 34, 35 and 25, and 26 and 36 are adjusted to be 90 mm.

Figure 20:
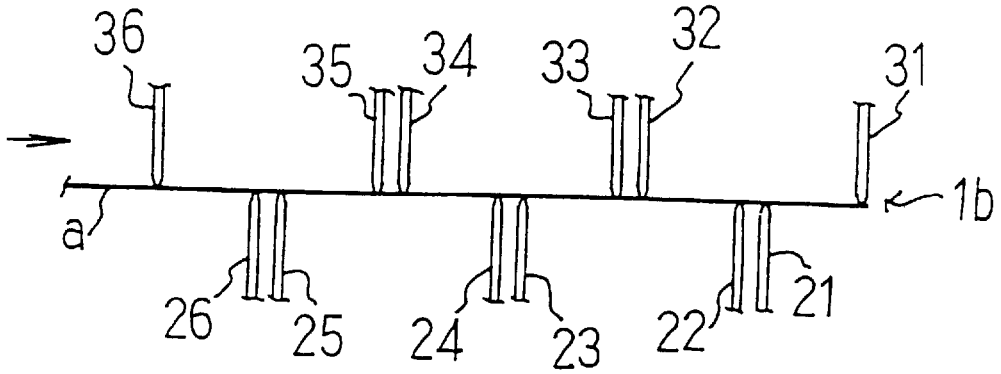
FIG. 20 is a partial side view showing the state wherein the respective folding working tools are set to the working position after the sheet is supplied there in the method of the 3rd embodiment of the present invention.

After sheet a is supplied to the working position 1*b* by the conveying means 1*a*, the tips of the respective working tools 21–26 and 31–36 are set to face the sheet a by operating the advancing drive means 7*a*, 7 as shown in FIG. 20.

Then, the lower working tools 21–26 are gradually raised approximately 80 mm by the folding drive means 4 and at the same time the respective working tools 21–26 and 31–36 are moved rightward by the shuttle drive means 5, 5*a*, 6, 6*a* and the shifting means 80, 81 and 9. At that time, the vacuum chuck 1*g* of the conveying means 1*a* is controlled so as to move in the same direction and at the same velocity as the last working tool 36.

While the respective working tools 21–26 and 31–36 are moved in this manner, the shifting means 9 is operated so as to keep the distances between the respective pairs of working tools, 32 and 33, 34 and 35, constant while they are moved, by slowing the moving velocities of the respective working tools 31, 33, 35 by the shuttle drive means 6 somewhat. The shifting means 80 is operated so as to keep the distances between the respective pairs of working tools, 21 and 22, 23 and 24, and 25 and 26 constant while they are moved, by increasing the moving velocities of the respective working tools 21, 23, 25 by the shuttle drive means 5 somewhat.

Figure 21:
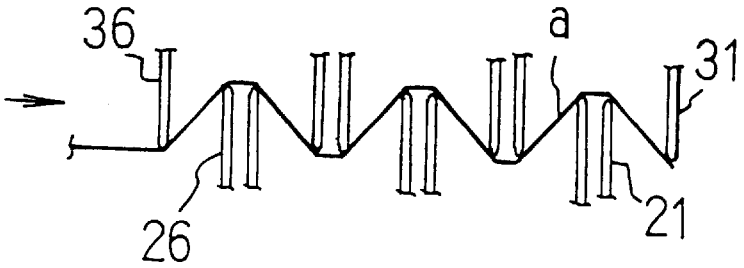
FIG. 21 is a partial side view showing the state wherein working process has proceeded from that shown in FIG. 20 and directional permanency of folding is imparted to the sheet to some extent.
Figure 22:
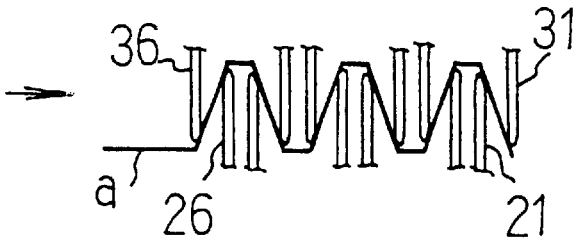
FIG. 22 is a partial side view showing the state wherein the working process has further proceeded from the state of FIG. 21 and directional permanency of folding is imparted to the sheet.

By controlling the apparatus as mentioned above, ridge-like folds a6 and valley-like folds a7 having an approximately U-shaped (or trapezoid) or reversed U-shaped sides are formed alternately among the pairs of the folding ruled lines a2, a2, through the state shown in FIG. 21, to the state shown in FIG. 22.

After the sheet a is folded as shown in FIG. 22, the respective working tools 21–26 and 31–36 are retracted upward and downward, respectively, by the advancing drive means 7, 7*a*. The part of the sheet, which has been folded, is received by a pair of belt conveyers not shown in the drawing. The folded sheet part received by the pair of belt conveyers is then extended flat. When the processed sheet part is received by the pair of belt conveyers, the last part of the processed part of the sheet is held so as not to proceed by restricting means not shown in the drawing.

Afterwards, the respective working tools 21–26 and 31–36 are returned to their initial positions by the shuttle drive means 5, 5*a*, 6, 6*a* and the apparatus is controlled to repeat the abovementioned processing cycle.

Figure 23:
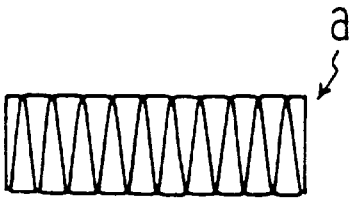
FIG. 23 is a schematic side view of a block manufactured from the sheet having directional permanency of folding imparted by the method of the 3rd embodiment.

The sheet a, imparted with directional permanency of folding by the method of the third embodiment, is conveyed to the pasting process in the extended state and both sides of the folds are pasted. As the sheet is conveyed to the final molding station and processed there, a hollow corrugated cardboard block of square shape as shown in FIG. 23 is produced.

Since, otherwise the method of the second embodiment is similar to that of the method of the first embodiment, explanation thereof is omitted.

4th Embodiment of the Method of Imparting Directional Permanency of Folding to a Sheet The 4th embodiment of the method of imparting directional permanency of folding to a sheet according to this invention will be explained together with an operation of the apparatus with the reference to FIGS. 1, 24 and 25.

Figure 24:
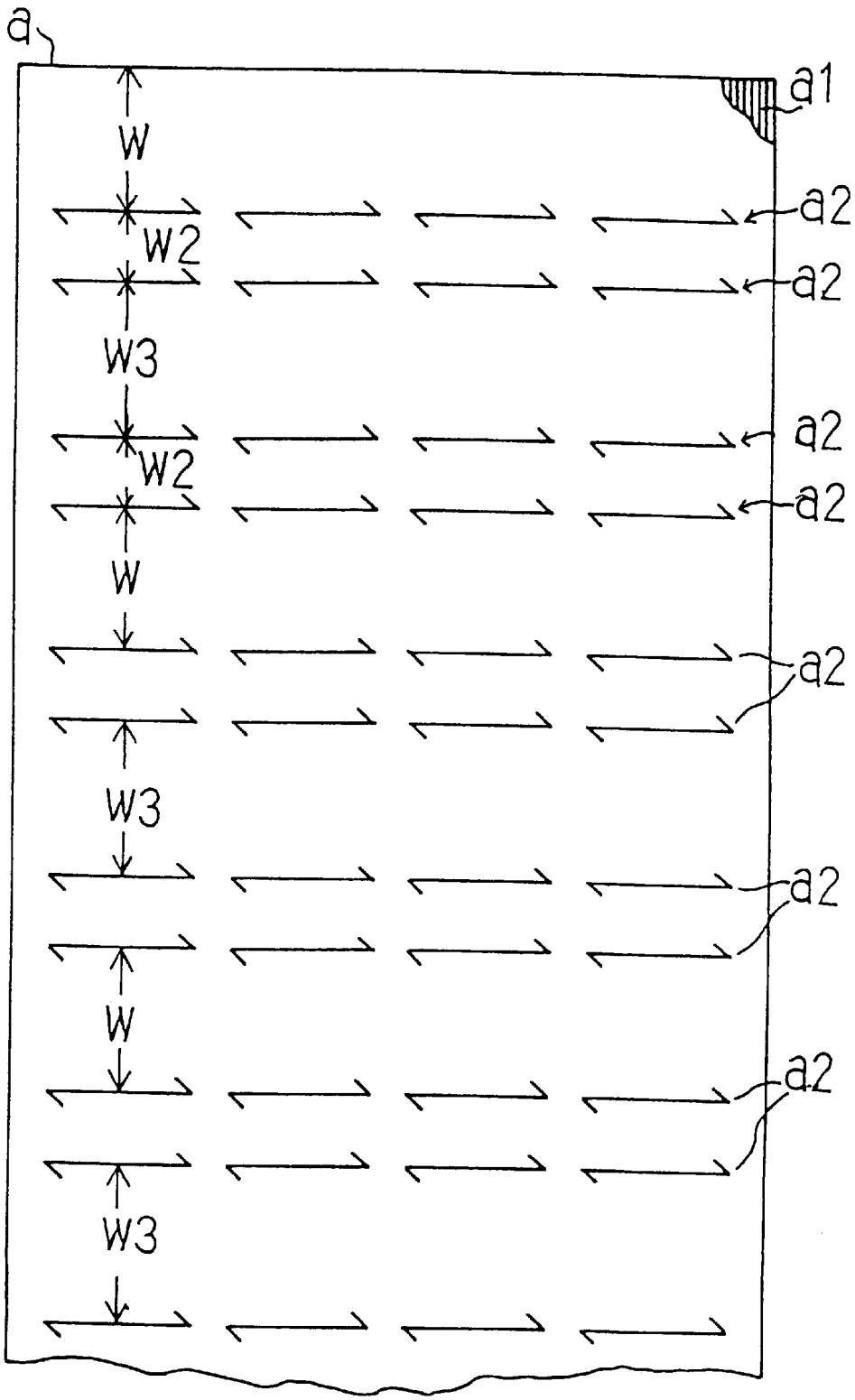
FIG. 24 is a plan view of a part of the sheet used in the method of the 4th embodiment of folding according to the present invention.

The sheet a used in this embodiment is a B type corrugated cardboard and pairs of folding ruled lines a2, a2 separated by a distance w2 of 50 mm are formed on this sheet a, with spacings between pairs a2, a2, alternating between a distance w of 100 mm and a distance w3 of a little less than 112 mm, as shown in FIG. 24.

The folding ruled lines a2, which have the same design as that of the first embodiment, are formed across the corrugations.

Figure 25A:
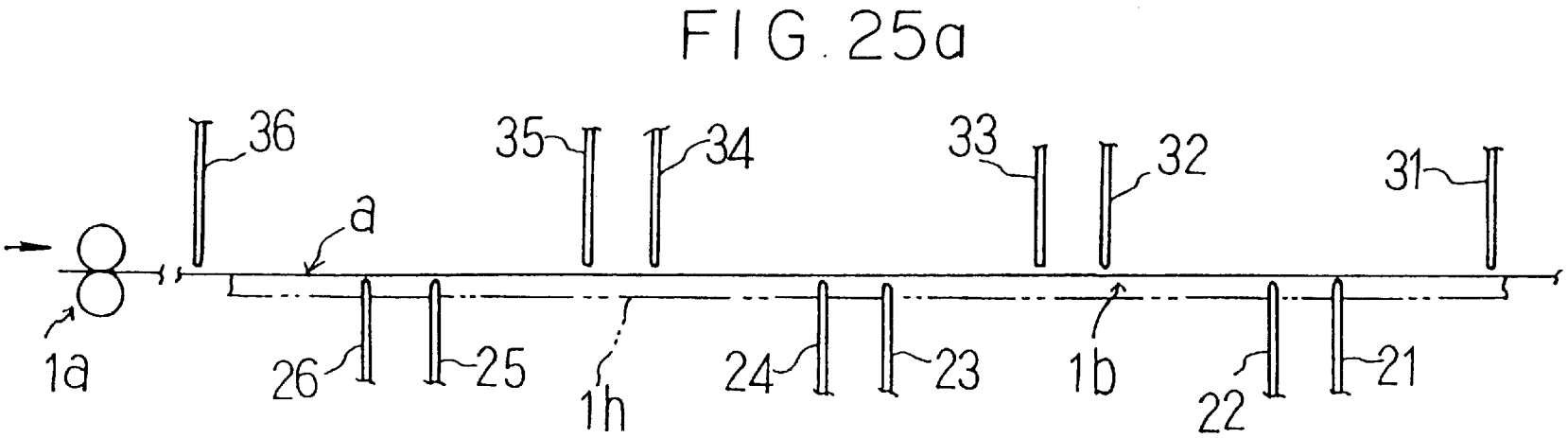
Figure 25B:
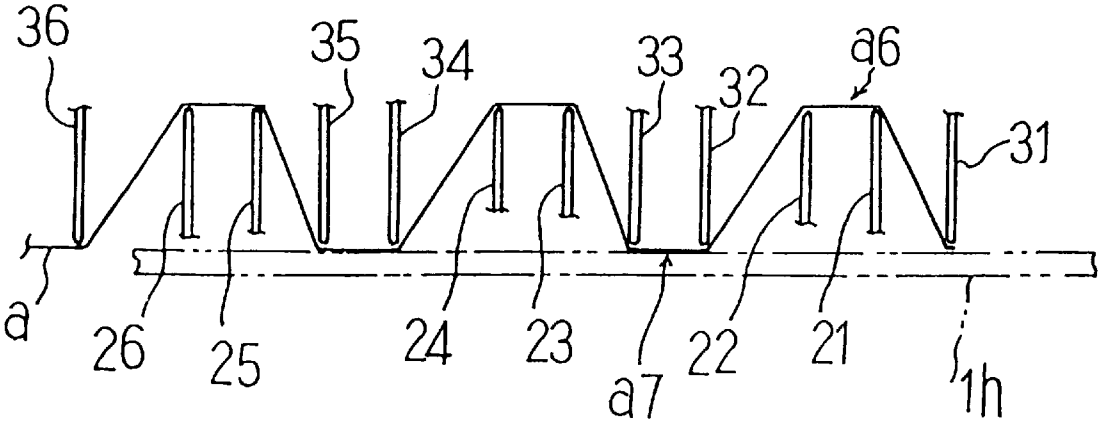
Figure 25C:
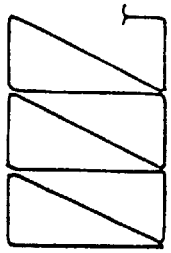
Figure 26A:
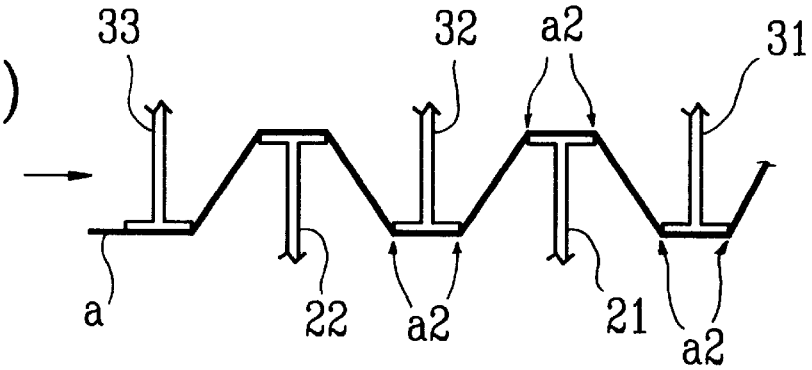
FIGS 26*a*–26*d* are partial side views of folding working tools of different shapes which may be utilized in the second embodiment of the invention.
Figure 26B:
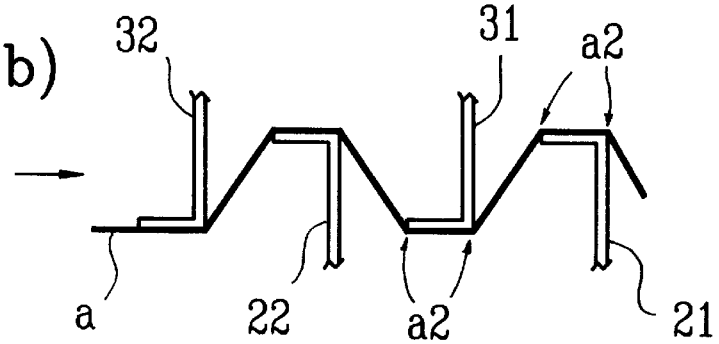
Figure 26C:
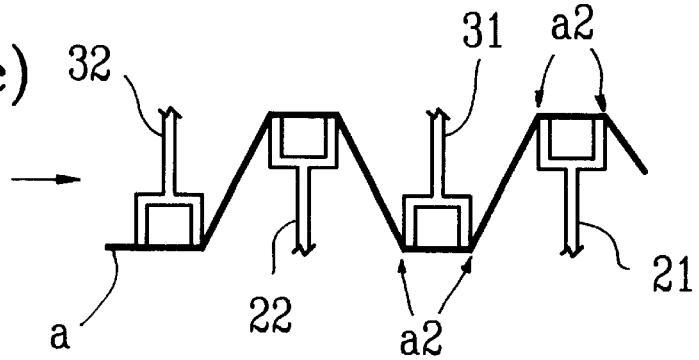
Figure 26D:
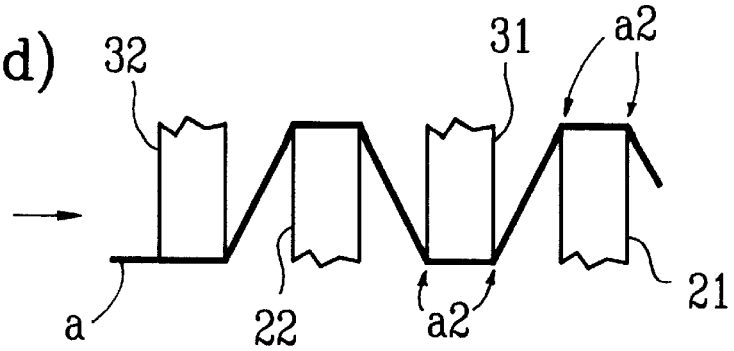

By operating the shifting means 80, 81 and 9 and the shuttle means 5, 5*a*, 6, 6*a*, as shown in FIG. 25(*e*), the mutual distances between the lower working tools 21–26 and the mutual distances between the lower working tools 31–36 are in accord with those of the respective folding ruled lines a2 formed on the sheet a of FIG. 24.

The sheet a is supplied to the working position 1*b* by the conveying means 1*a* and then the respective working tools 21–26 and 31–36 are set by the advancing drive means 7, 7*a* to face the sheet a as shown in FIG. 25(*a*).

Then, the lower working tools 21–26 are gradually raised by approximately 90 mm and the respective working tools 21–26 and 31–36 are moved rightward in the third embodiment.

By this operation, as shown in FIG. (b), the distances between the respective working tools 31 and 21, 33 and 23, 24 and 34, 35 and 25, 26 and 36 are shortened in a uniform ratio, while the distances between the working tools of the pairs, 21 and 22, 32 and 33, 23 and 24, 34 and 35, 25 and 26, are kept constant.

By controlling the apparatus as mentioned above, ridge-like folds a6 and valley-like folds a7 having somewhat deformed trapezoid or reversed trapezoid sides are formed alternately along the respective pairs of the folding ruled lines a2, a2 in the sheet a through the state shown in FIG. 25(*a*).

When the sheet a has been folded as mentioned above, the respective working tools 21–26 and 31–36 are retracted upward or downward, respectively, by the advancing drive means 7, 7*a* and the processed part of the sheet a is received by a pair of belt conveyers not shown in the drawing.

Afterwards, the respective working tools 21–26 and 31–36 are returned to their original positions by the shuttle drive 5, 5*a*, 6, 6*a* and the apparatus is controlled so as to repeat the abovementioned cycle.

The sheet a having directional permanency of folding imparted by the method of the fourth embodiment is conveyed to the pasting process while extended and, after both sides of the folds have been pasted, is conveyed to the final molding process. Then a corrugated cardboard hollow block of a square shape is manufactured as shown in FIG. 25(*c*).

Since the method of the fourth embodiment is otherwise similar to the method of the third embodiment, explanation thereof is omitted. Advantages of the Apparatus of the First Embodiment In the apparatus for imparting directional permanency to a sheet according to the first embodiment, the sheet a can be imparted directional permanency of folding so as to be folded in zigzag along the folding ruled lines a2 of the sheet a accurately, since the apparatus is provided with the folding working tools 21–26 and the folding working tools 31–36, the lower working tools 21–26 are shifted by the folding drive means 4 so that they are advanced to the opposite side of the sheet a and, concurrently with the shift, the respective folding working tools 21–26 and 31–36 are controlled to be moved in the same direction by the shuttle drive means 5, 5*a*, 6, 6*a* so that the distances therebetween are shortened in a uniform ratio.

In the apparatus according to the first embodiment, the processed sheet a can be smoothly conveyed to further processing, since the advancing drive means 7, 7*a* move the respective working tools 21–26 and 31–36 away from or toward the sheet a.

In addition, by providing the above advancing drive means 7, 7*a*, the control cycle of imparting directional permanency of folding to the sheet a can be repeated.

In the apparatus of the first embodiment, the shifting means 80, 81 and 9 shift the respective folding working tools 21–26 and 31, 33, 35, to properly adjust their relative positions and the moving velocity of the respective working tools 21–26, 31, 33, 35 can be adjusted by the shuttle drive means 5, 5*a*, 6.

Accordingly, directional permanency of folding can be imparted to the sheet a by a single apparatus so that the sheet is folded in zigzag and so that ridge-like (reversed U-shaped) folds and valley-like (U-shaped) folds are formed alternately in the sheet a.

In addition, the moving velocity of the respective working tools 21–26 and 31–36 can be corrected very easily and controlled more accurately, since the shifting means 80, 81 and 9 are respectively composed of the respective screw shafts 80*h*, 81*h* and 9*b* for each of which the number of rotations is properly controlled by the respective motors 80*g*, 81*g* and 9*a*, and the screw guides 80*i*, 81*i* and 9*c* through which the shafts penetrate, etc.

According to the apparatus of the first embodiment, when some of the working tools are not required for imparting directional permanency to the sheet a (some of the working tools 21–26 may be unnecessary depending on the distance between the folding lines a2 of the sheet a in a given design, these working tools can be retracted independently, since the respective folding working tools 21–26 on one side of the working position are respectively provided with actuators 21*a*–26*a* for moving them independently toward or away from the sheet a.

The apparatus is simple, since the actuators 21*a*–26*a* also function as the advancing drive means 7*a*.

The apparatus of the first embodiment is very advantageous for repeating the cycle of imparting directional permanency of folding and conveying of the sheet a, since it is provided with the conveying means 1*a* for supplying the sheet a to the working position 1*b* by conveying it longitudinally and the shuttle drive means 5, 5*a*, 6, 6*a* move the respective folding working tools in the direction of conveyance by the conveying means.

According to the apparatus of the first embodiment, the sheet a can be supplied to the working position 1*b* in a stable state and directional permanency of folding of the sheet a can be performed smoothly, since the apparatus is provided with, at the working position 1*b* of the sheet a, the sheet guides 1*h*, which consist of many guide bars 1*i*, are disposed in parallel and along the longitudinal direction of the sheet and with, corresponding to the guide bars 1*i*, many indentations 20 provided on the tip parts of the folding working tools 21–26 shifted by the folding drive means 4.

According to the first embodiment, operations of the respective working tools can be controlled easily, since the sheet a is supplied horizontally to the working position, the respective folding working tools 21–26 facing one side of the sheet a are disposed so as to face the sheet from underneath and the respective folding working tools 31–36 facing the other side of the sheet a are disposed so as to face the sheet from above.

The respective working tools 21–26 and 31–36 can be controlled very easily so that the initial distances between them are shortened in a uniform ratio, since the shuttle drive means 5, 5*a*, 6, 6*a* are provided with the respective sprockets corresponding to the folding working tools 21–26 and 31–36 and with timing belts respectively mounted on the sprockets. Because the sprocket corresponding to the respective folding working tools 21–26 facing the one side of the sheet a and the sprocket corresponding to the respective folding working tools 31–36 facing the other side of the sheet a are driven by different motors the circumferential velocities of the respective timing belts can be different.

Also in the first embodiment, since the main parts of the folding working tools 21–26 and 31–36 are connected to the base parts exchangeably, the main parts can be exchanged easily.

In addition, since the base parts of the folding working tools 21–26 and 31–36 are plates, it is easy to impart the abovementioned directional permanency of folding to the sheet a. The Apparatus of the Second Embodiment The second embodiment has working tools 21–26 with a T-shaped section as shown in FIG. 26(*a*), with a L-shaped section as shown in FIG. 26(*b*), with a U or Y-shaped section as shown in FIG. 26(*c*) and with a thickness the same as the distance between the ruled lines pair a2, a2 as shown in FIG. 26(*d*) respectively.

When the method of the third embodiment or the fourth embodiment is carried out using the apparatus of the second embodiment, the amount of shifting of the working tools can be made smaller by using folding working tools 21–26 and 31–36, having cross-sections as shown in FIGS. 26(*a*)–26(*d*).

The Other Embodiments

Although only the lower folding tools 21–26 are moved in the direction of the sheet a by the folding drive means 4 in the apparatus of the above embodiments, both the upper and lower working tools may be moved in the folding direction of the sheet a simultaneously. Alternatively, only the upper folding working tools may be moved in the folding direction of the sheet a.

Although corrugated cardboard is described as the sheet a in the method of above-mentioned embodiments, an ordinary pasteboard can be used for the sheet a. When the sheet a is pasteboard, the folding ruled lines a2 may be pressed lines formed by pressing the corresponding portion of the sheet a linearly or may be intermittent cut lines such as perforated lines.

The sheet a may be cut out to a suitable flat shape according to the design of the product and, if required, indentations (cut outs) or holes (openings) may be formed in the sheet a.

Further, the sheet a may be synthetic paper or other material as long as it has a thickness of some extent and is capable of being folded.

By using the apparatus of the first embodiment, disposing the respective folding working tools 21–26 and 31–36 as shown in FIG. 14(*b*), imparting directional permanency of folding to the sheet a, disposing the respective folding working tools 21–26 and 31–36 as shown in FIG. 20 or FIG. 25(*e*) and imparting directional permanency of folding to the sheet a, directional permanency of folding can be imparted to the sheet a such that the folds as shown in FIG. 14(*b*) and the folds as shown in FIG. 20 or FIG. 25(*e*) are formed in combination.

The shuttle drive means for moving the respective folding working tools 21–26 and 31–36 during working while shortening their initial distances in a uniform ratio, the shifting means for shifting the working tools 21–26 and 31–36, and the advancing drive means for moving the working tools 21–26 and 31–36 away from the sheet a as required may be provided separately for the respective folding working tools 21–26 and 31–36. In this manner, the mutual distances intervening between the respective working tools 21–26 and 31–36 can be set and adjusted more freely. And when directional permanency of ridge-like folding and directional permanency of valley-like folding are imparted to the sheet a alternately, even if the distance between the folding ruled lines or the distance between the folding ruled lines of the pair differs in the same sheet a, the directional permanency of folding can be accurately imparted along the folding ruled lines a2 or the pairs of the folding ruled lines a2, a2.

In addition, in the above-mentioned constitution, directional permanency of folding can be imparted to a sheet by arbitrarily selecting a single working tool or a single pair of the working tools among the respective folding working tools 21–26 and 31–36 as a reference and moving the other working tools toward the working tool or the pair of working tools selected as the reference, while the shuttle drive means for the working tool(s) of the reference is not operated.

The method of imparting directional permanency of folding to a sheet and the apparatus therefor according to the present invention are useful for manufacturing a block product, such as frames for packaging and cushioning members, from a sheet of paper or other easily recyclable materials.

What is claimed is:

1. A method of imparting directional permanency of folding to a sheet, having parallel opposing edges extending along a longitudinal dimension of the sheet and a plurality of pairs of parallel ruled folding lines which are orthogonal to the longitudinal dimension, by forming ridge-like and valley-like folds in the sheet, said method comprising the steps of:

a first step of conveying the sheet along a linear path extending to and including a planar working position;

a second step of disposing pairs of folding working tools in initial positions aligned with corresponding pairs of the respective ruled folding lines on a surface of the sheet which becomes an inner surface when the sheet is folded along the respective ruled folding lines;

a third step of moving said pairs of folding working tools perpendicular to the planar working position to engage and fold the sheet along the respective pairs of the ruled folding lines;

a fourth step of shifting the folding working tools engaging the sheet, parallel to the linear path, to shorten distances between the respective pairs of the folding working tools in accordance with a ratio based on an apparent amount of shortening of the longitudinal dimension caused by the shifting, in synchronization with the third step;

a fifth step of retracting the respective pairs of the folding working tools from the sheet after the fourth step;

a sixth step of returning the respective pairs of the folding working tools to their initial positions; and repeating the first through the sixth steps; and wherein the sheet is a corrugated cardboard, and at least some of the ruled lines are intermittent cutting lines formed by cutting the sheet intermittently across corrugations and are each composed of cuts of a predetermined length formed in the sheet and non-cut portions of a shorter length than the predetermined length, said cuts and non-cut portions alternating across one dimension of the corrugated cardboard, transverse to the corrugations, and, extending obliquely from each end of each cut, an additional cut of a shorter length then said predetermined length.

2. A method of imparting directional permanency of folding to a sheet, having parallel opposing edges extending along a longitudinal dimension of the sheet and a plurality of pairs of parallel ruled folding lines which are orthogonal to the longitudinal dimension, by forming ridge-like and valley-like folds in the sheet, said method comprising the steps of:

a first step of conveying the sheet along a linear path extending to and including a planar working position;

a second step of disposing pairs of folding working tools in initial positions aligned with corresponding pairs of the respective ruled folding lines on a surface of the sheet which becomes an inner surface when the sheet is folded along the respective ruled folding lines;

a third step of moving said pairs of folding working tools perpendicular to the planar working position to engage and fold the sheet along the respective pairs of the ruled folding lines;

a fourth step of shifting the folding working tools engaging the sheet, parallel to the linear path, to shorten distances between the respective pairs of the folding working tools in accordance with a ratio based on an apparent amount of shortening of the longitudinal dimension caused by the shifting, in synchronization with the third step;

a fifth step of retracting the respective pairs of the folding working tools from the sheet after the fourth step;

a sixth step of returning the respective pairs of the folding working tools to their initial positions; and repeating the first through the sixth steps; and wherein the sheet is a pasteboard, and at least some of the ruled lines are one of pressed lines formed in the sheet by a press and intermittent cutting lines formed in the sheet by cutting.

3. An apparatus for imparting directional permanency of folding to a sheet having parallel opposing edges extending along a longitudinal dimension of the sheet, and a plurality of parallel ruled folding lines which are orthogonal to the longitudinal dimension;

a plurality of folding working tools which, in a standby position, are spaced a predetermined distance apart along the longitudinal dimension of the sheet and are alternately positioned on opposing sides of a planar working position for receiving the sheet, said folding working tools having distal edges which, in initial positions, are in alignment with the ruled folding lines when the sheet is received at the working position, each of said folding working tools including a base portion and a main portion with one of said distal edges, said main portions being exchangeably connected to said base portions;

advancing drive means for moving a first plurality of said working tools perpendicular to the planar working position between a position adjacent the sheet and a retracted position;

folding drive means for moving a second plurality of said folding working tools perpendicular to the sheet to bend the sheet to some extent along the respective ruled folding lines and for returning the working tools by movement away from the sheet; and shuttle drive means for moving at least one of said pluralities of folding working tools parallel to the planar working position and relative to each other in accordance with a uniform ratio and for returning the working tools to their initial positions.

4. The apparatus for imparting directional permanency to a sheet according to claim 3 further comprising:

conveying means for transporting the sheet to the working position through a path defining a conveyance direction; and wherein the shuttle drive means move the respective folding working tools in the conveyance direction.

5. The apparatus for imparting directional permanency to a sheet according to claim 3 further comprising:

a plurality of guide bars arranged in a parallel array extending along the direction of the longitudinal dimension of the sheet at the working position, wherein said distal edges of said folding working tools have grooves corresponding to the guide bars.

6. The apparatus for imparting directional permanency to a sheet according to claim 3, wherein the sheet is conveyed to the working position horizontally and one plurality of the folding working tools is arranged below the working position, facing one side of the sheet, and a second plurality of working tools is arranged above the working position, facing the other side of the sheet.

7. The apparatus for imparting directional permanency to a sheet according to claim 3, wherein said shuttle drive means comprises at least first and second shuttle drives respectively located on opposite sides of said working position;

wherein each of said shuttle drives comprises:

at least one pair of sprockets;

endless drive bands mounted around the one pair of sprockets and supporting a plurality of said folding working tools;

pairs of guide rails which guide movement of the respective folding working tools; and a motor for driving one of said sprockets; and wherein the motors of said first and second shuttle drives are separately operable to allow the endless drive bands of said first shuttle drive to be driven at different speeds than the endless drive bands of said second shuttle drive.

8. The apparatus for imparting directional permanency to a sheet according to claim 3, wherein the main portions of the folding working tools are plates.

9. The apparatus of imparting directional permanency to a sheet according to claim 3 further comprising actuators for independently moving at least some of the folding working tools toward and away from the planar working position.

10. An apparatus for imparting directional permanency of folding to a sheet having parallel opposing edges extending along a longitudinal dimension of the sheet, and a plurality of parallel ruled folding lines which are orthogonal to the longitudinal dimension;

a plurality of folding working tools which, in a standby position, are spaced a predetermined distance apart along the longitudinal dimension of the sheet and are alternately positioned on opposing sides of a planar working position for receiving the sheet, said folding working tools having distal edges which, in initial positions, are in alignment with the ruled folding lines when the sheet is received at the working position, each of said folding working tools including a base portion and a main portion with one of said distal edges, said main portions being exchangeably connected to said base portions;

advancing drive means for moving a first plurality of said working tools perpendicular to the planar working position between a position adjacent the sheet and a retracted position;

folding drive means for moving a second plurality of said folding working tools perpendicular to the sheet to bend the sheet to some extent along the respective ruled folding lines and for returning the working tools by movement away from the sheet; and shuttle drive means for moving at least one of said pluralities of folding working tools parallel to the planar working position and relative to each other in accordance with a uniform ratio and for returning the working tools to their initial positions; and shifting means for shifting the other plurality of the folding working tools to shorten or elongate the distances between adjacent working tools.

11. The apparatus for imparting directional permanency to a sheet according to claim 10, wherein said shifting means include screw shafts, screw guides through which said screw shafts extend, and motors for rotatably driving said screw shafts.

12. A method of imparting directional permanency of folding to a sheet, having parallel opposing edges extending along a longitudinal dimension of the sheet and a plurality of parallel ruled folding lines which are orthogonal to the longitudinal dimension, by forming ridge-like and valley-like folds in the sheet, said method comprising:

a first step of conveying the sheet along a linear path to and including a planar working position defined by a support surface;

a second step of disposing working tools in initial positions with each of the working tools aligned with a different one of respective ruled folding lines, on at least one surface of the sheet, the working tools in the initial positions being arranged, with spacings therebetween, in a linear array extending parallel to the linear path and coextensive with the planar working position, with one working tool located at one end of the array designated as a reference working tool;

a third step of bringing the working tools into engagement with the respectively aligned ruled folding lines and shifting at least a first plurality of the working tools, parallel to the linear path, in one direction, for folding the sheet along the respective ruled folding lines; and a fourth step of moving the working tools other than the reference tool, while engaging the sheet, toward the reference working tool, to shorten the spacings between working tools, in accordance with a ratio based on an apparent amount of shortening of the longitudinal dimension caused by the shifting, in synchronization with the third step; and wherein the sheet is a corrugated cardboard, and at least some of the ruled lines are intermittent cutting lines formed by cutting the sheet intermittently across corrugations and are each composed of cuts of a predetermined length formed in the sheet and non-cut portions of a shorter length than the predetermined length, said cut and non-cut portions alternating across one dimension of the corrugated cardboard, transverse to the corrugations, and, extending obliquely from each end of each cut, an additional cut of a shorter length then said predetermined length.

13. A method of imparting directional permanency of folding to a sheet, having parallel opposing edges extending along a longitudinal dimension of the sheet and a plurality of parallel ruled folding lines which are orthogonal to the longitudinal dimension, by forming ridge-like and valley-like folds in the sheet, said method comprising:

a first step of conveying the sheet along a linear path to and including a planar working position defined by a support surface;

a second step of disposing working tools in initial positions with each of the working tools aligned with a different one of respective ruled folding lines, on at least one surface of the sheet, the working tools in the initial positions being arranged, with spacings therebetween, in a linear array extending parallel to the linear path and coextensive with the planar working position, with one working tool located at one end of the array designated as a reference working tool;

a third step of bringing the working tools into engagement with the respectively aligned ruled folding lines and shifting at least a first plurality of the working tools, parallel to the linear path, in one direction, for folding the sheet along the respective ruled folding lines; and a fourth step of moving the working tools other than the reference tool, while engaging the sheet, toward the reference working tool, to shorten the spacings between working tools, in accordance with a ratio based on an apparent amount of shortening of the longitudinal dimension caused by the shifting, in synchronization with the third step; and wherein the sheet is a pasteboard, and at least some of the ruled lines are one of pressed lines formed in the sheet by a press and intermittent cutting lines formed in the sheet by cutting.

* * * * *